US009675896B2

(12) United States Patent
Morikawa et al.

(10) Patent No.: US 9,675,896 B2
(45) Date of Patent: Jun. 13, 2017

(54) WALKING TOY AND WALKING TOY SET

(71) Applicant: MD Works Company Limited, Saitama-shi (JP)

(72) Inventors: Ryota Morikawa, Saitama (JP); Takayuki Takano, Saitama (JP)

(73) Assignee: MD Works Company Limited, Saitama-shi (JP)

( * ) Notice: Subject to any disclaimer, the term of this patent is extended or adjusted under 35 U.S.C. 154(b) by 135 days.

(21) Appl. No.: 14/609,676

(22) Filed: Jan. 30, 2015

(65) Prior Publication Data

US 2015/0217202 A1 Aug. 6, 2015

(30) Foreign Application Priority Data

Jan. 31, 2014 (JP) ..... 2014-016730

(51) Int. Cl.

| | |
|---|---|
| ***A63H 11/18*** | (2006.01) |
| ***A63H 29/04*** | (2006.01) |
| ***A63H 31/08*** | (2006.01) |
| ***A63H 29/22*** | (2006.01) |

(52) U.S. Cl.

CPC ..... *A63H 11/18* (2013.01); *A63H 29/04* (2013.01); *A63H 29/22* (2013.01); *A63H 31/08* (2013.01)

(58) Field of Classification Search

CPC ..... A63H 3/00; A63H 11/00; A63H 11/18; A63H 13/00; A63H 13/02; A63H 29/04; A63H 29/24; A63H 31/00; A63H 31/08

See application file for complete search history.

(56) References Cited

U.S. PATENT DOCUMENTS

| | | | | | |
|---|---|---|---|---|---|
| 1,724,094 | A * | 8/1929 | Kuen | A63H 11/18 | 446/355 |
| 1,800,874 | A * | 4/1931 | Savage | A63H 11/20 | 446/355 |
| 1,986,446 | A * | 1/1935 | Powleson | A63H 11/18 | 446/355 |
| 2,218,065 | A * | 10/1940 | Berger | A63H 11/00 | 446/313 |
| 2,736,556 | A * | 2/1956 | Dasher | A63F 9/14 | 446/314 |
| 2,752,726 | A * | 7/1956 | Calverley | A63H 3/16 | 403/142 |

(Continued)

FOREIGN PATENT DOCUMENTS

| | | | | |
|---|---|---|---|---|
| JP | 2003190653 | A * | 7/2003 | A63H 15/02 |

*Primary Examiner* — Gene Kim
*Assistant Examiner* — Alyssa Hylinski
(74) *Attorney, Agent, or Firm* — The Webb Law Firm

(57) ABSTRACT

A walking toy includes a body on which gravity center position adjusting members and paired legs are supported to be able to swing in a forward/backward direction, and a gearbox which has a crank mechanism for forcibly swinging the paired legs alternately forward and backward in a forcible swinging direction and which is mounted in the body. Each of the paired legs has a bottom which is configured to be in contact with a floor surface and which is formed into a curved face curved in the forcible swinging direction. The gearbox is driven by a torsion coil spring and has a lever which rotates a drive gear of a gear train for transmitting rotation of the torsion coil spring to an output shaft for rotating the crank mechanism.

9 Claims, 18 Drawing Sheets

(56) References Cited

U.S. PATENT DOCUMENTS

| | | | | | |
|---|---|---|---|---|---|
| 2,961,794 | A * | 11/1960 | Sachs | A63H 13/00 | 40/411 |
| 4,171,133 | A * | 10/1979 | Morrison | A63H 33/00 | 273/127 C |
| 4,944,708 | A * | 7/1990 | Kawabe | A63H 11/18 | 446/175 |
| 5,628,668 | A | 5/1997 | Takemae | | |
| 6,500,044 | B1 * | 12/2002 | Sasuga | A63H 11/18 | 446/354 |
| 6,746,302 | B2 * | 6/2004 | Morikawa | A63H 29/04 | 446/353 |
| 2002/0187724 | A1 * | 12/2002 | Sasuga | A63H 11/18 | 446/330 |
| 2004/0127141 | A1 * | 7/2004 | Sakai | A63H 29/22 | 446/317 |

* cited by examiner

WALKING TOY AND WALKING TOY SET

CROSS-REFERENCE TO RELATED APPLICATION

This application claims priority to Japanese Patent Application No. 2014-016730 filed Jan. 31, 2014, the disclosure of which is hereby incorporated in its entirety by reference.

BACKGROUND OF THE INVENTION

Field of the Invention

The present invention relates to a walking toy powered by a spring. More specifically, the invention relates to a walking toy which can walk upright on two foot and is caused to walk or run in an arbitrary direction while shuffling without separating its feet from a floor surface.

Description of Related Art

In the present specification, a walking direction is referred to as a forward/backward direction, a horizontal direction orthogonal to the walking direction is referred to as a left/right direction, and an up/down direction is referred to as a vertical direction. The left/right direction refers to a width direction. In the specification, surfaces on which the toy is caused to walk are referred to collectively as a floor surface.

As conventional toy, there is a toy which can walk briskly by moving both feet alternately forward and backward in a shuffling manner without separating the feet from a floor surface as disclosed in U.S. Pat. No. 5,628,668.

This toy has two leg members and two foot members having the same lengths and capable of swinging forward and backward with respect to a body. Crank pins of crank mechanisms provided with a phase difference of 180° therebetween to opposite ends of an output shaft of a spring-driven gearbox are respectively engaged with vertical elongated holes formed in the paired leg members. By converting rotation of the output shaft of the gearbox into forward and backward swing movements of the leg members and the foot members via the crank mechanisms, the paired leg members and the paired foot members move alternately forward and backward. Therefore, instead of walking while completely spacing a bottom of each of feet from the floor surface, the toy walks with the bottoms of the feet in slight contact with the floor surface while moving the left and right feet alternately forward and backward in a shuffling manner.

This toy is characterized in that it wanders and moves around freewheelingly, because a traveling direction of the toy is changed by a slight change in frictional resistance.

However, the walking toy disclosed in U.S. Pat. No. 5,628,668 has a basic problem of displacement of a center of gravity in a leftward or rightward direction caused by a winding knob for winding a spiral spring of the gearbox and sticking out sideways in a left-right direction of the body.

Moreover, the winding knob needs to be in a certain size so that it can be pinched with fingertips and turned irrespective of a size of the toy. Therefore, the smaller the toy, the greater the influence of the knob on the displacement of the center of gravity in the left-right direction becomes. The knob makes an attitude of the toy unstable and causes the toy to fall down during walking.

Furthermore, a gravity center position adjusting member for adjusting a position of the center of gravity of the toy can be provided only to a side of the body opposite from a side on which the winding knob sticks out. Therefore, a moving range of the center of gravity is limited to the one side of the toy, which makes movements of the toy monotonous.

Moreover, the operation of pinching the winding knob with fingertips and turning it cannot be carried out by one hand. If a user winds the toy placed on the floor surface, he/she needs to pinch the winding knob with his/her fingertips to wind it while holding down the toy and such an operation is not easy for infant users.

If a user holds the toy in his/her hand and winds the winding knob, he/she tends to upset balance of a standing attitude of the toy when he/she puts the toy down on the floor surface and lets go of the toy and easily causes the toy to fall down immediately after the toy starts walking.

In either case, the operation of pinching the winding knob with fingertips and turning it is a difficult operation for infants who like this type of toy. If the toy repeatedly falls down, it may quickly put the infants off playing with the toy. Therefore, such improvements as to make the toy easy for the infants to play with are desired to be made.

Moreover, the spring-driven gearbox requires a space for housing the spiral spring which expands in a radial direction, resulting in increase in size of the gearbox. The winding knob which is turned while pinched with fingertips also needs to be in a certain size. Therefore, there is a limit to reduction in size of the gearbox, which leads to difficulty in reduction in size of a body of the toy having the gearbox mounted therein and reduction in size of the toy.

Furthermore, though the gravity center position adjusting member for adjusting the position of the center of gravity of the toy is provided to one side face of the body to be able to turn forward and backward in the walking toy disclosed in U.S. Pat. No. 5,628,668, the member cannot be detached and is only for changing the position of the center of gravity.

Therefore, a user plays with the toy, just enjoying changes in the movement of the toy. It is impossible to impart plots such as changes in a character embodied by the toy, e.g., growing up of the character and upgrades of functions to the toy. Moreover, it is impossible to change quality of the movement as the character grows up and functions are upgraded.

Furthermore, a user plays with the walking toy by simply causing the toy to walk straight forward or backward on the floor surface, walk forward or backward while turning, or turn around or step in place. The toy is lacking in elements of competition play in which the toy competes against a walking toy of another user.

SUMMARY OF THE INVENTION

It is an object of the present invention to provide a walking toy which walks in a stable attitude and is less liable to fall down during walking. It is an object of the invention to provide a walking toy which can be easily wound up with one hand so as to be easy for infants to play with. Moreover, it is an object of the invention to provide a walking toy which is rich in change in movement of the toy and has an element of competition play. Furthermore, it is an object of the invention to provide a walking toy which can be reduced in size. It is an object of the invention to provide a walking toy to which a plot such as growing up of a character embodied by the toy and an upgrade of a function can be imparted and which can be changed in quality of movement as the character grows up or the function is upgraded.

To achieve the object, according to the invention, there is provided a walking toy including a body on which gravity center position adjusting members and paired legs are supported to be able to swing in a forward/backward direction and a gearbox which has a crank mechanism for forcibly swinging the paired legs alternately forward and backward and which is mounted in the body, the paired legs having bottoms which are in contact with a floor surface and which are formed into curved faces curved in the forcible swinging direction and the floor surface and the paired legs being constantly in contact with each other to allow the walking toy to travel by using the paired legs, wherein the gearbox is driven by a torsion coil spring and has a lever which rotates a drive gear of a gear train for transmitting rotation of the torsion coil spring to an output shaft for rotating the crank mechanism and which has a tip end portion protruding to an outside of the body, and the torsion coil spring is disposed between the lever and a frame of the gearbox and twisted and wound by pushing down of the lever.

According to the above-described walking toy, the torsion coil spring is wound only by pushing down of the lever and therefore it is possible to operate the walking toy placed on the floor surface with one hand. Moreover, the winding of the torsion coil spring is completed with one push of the lever and therefore the winding is quicker than when a winding knob has to be wound over and over again.

Because the simple operation of pushing down the lever of the toy placed on the floor surface is a simple movement which infants can make, the toy becomes suitable for infants to play with. Moreover, because it is unnecessary to put the toy down on the floor surface after temporarily holding the toy in a hand and winding the spring, a user does not upset balance of an attitude of the toy when he/she lets go of the toy. Therefore, it is possible to achieve the toy which rarely falls down immediately after the toy starts walking and which is easy to play with.

The above-described walking toy requires neither a space for housing a spiral spring which expands in a radial direction nor a winding knob in such a size that it can be pinched with fingertips and turned. Therefore, the gearbox for driving can be reduced in size and, as a result, the body of the toy in which the gearbox is mounted can be reduced in size as well. By using the torsion coil spring, it is possible to reduce cost.

In the above-described walking toy, displacement of a position of a center of gravity in a left/right direction, which is one of factors causing the toy to fall down during walking, is suppressed. As a result, balance during walking is stabilized and the toy becomes less liable to fall down.

In the walking toy according to the invention, the lever may be provided at a center in a left/right direction of the gearbox so as to be able to swing in a vertical direction and the gearbox may be set in the body to be disposed at a center in the left/right direction of the body.

In the above-described walking toy, the gearbox and the lever are disposed at the center in the left/right direction of the body and therefore the position of the center of gravity of the walking toy in the left/right direction is disposed at the center. As a result, the balance during walking is further stabilized and the toy becomes less liable to fall down.

In the above-described walking toy, the position of the center of gravity in the left/right direction is disposed at the center and therefore movement of the center of gravity by use of the gravity center position adjusting members has a large influence and can bring a great change to movement of the toy. In this way, even relatively light gravity center position adjusting members can bring various changes to the movement of the toy. As a result, even if the entire toy is made compact, the toy can make movements rich in change.

In the walking toy according to the invention, the lever may have a disc portion at a center of rotation of the lever, the drive gear may be formed at a portion of a peripheral face of the disc portion, a space for housing the torsion coil spring may be formed on an inner side of the lever and the drive gear, one end of the torsion coil spring may be housed in an internal space extending toward a tip end side of the lever, the other end of the torsion coil spring may be in contact with the frame of the gearbox outside the internal space, and the torsion coil spring may be twisted along a vertical plane orthogonal to the center of rotation of the lever at a center in a left/right direction of the body.

In the above-described walking toy, the lever and the drive gear are formed integrally and the torsion coil spring is housed on the inner side of the lever and the drive gear. As a result, the lever, the drive gear, and the torsion coil spring are substantially disposed in one plane orthogonal to the center of rotation, which can reduce a thickness of the gearbox in the left/right direction.

In the walking toy according to the invention, the gravity center position adjusting members may be disposed on opposite sides of the body, each of the gravity center position adjusting members may include an arm movably connected to the body and an equipment item to be attached to a tip end of the arm, and the arm may have, at a tip end of the arm, a grasping portion for grasping the equipment item in such a manner that the equipment item can be detached.

In the above-described walking toy, each of the gravity center position adjusting members includes the arm movably connected to the body and the equipment item to be attached to the tip end of the arm and the grasping portion grasps the equipment item in such a manner that the equipment item can be detached. Therefore, it is possible to attach various equipment items.

Here, the equipment item is for adjusting the center of gravity and, at the same time, serves as a prop for imparting a plot to a character of the walking toy. Therefore, by attaching the equipment item suggesting growing up of the character embodied by the toy or an upgrade of a function, it is possible to impart the plot to the toy.

Moreover, by replacing the equipment item, it is possible to change quality of the movement of the toy as the character grows up or the function is upgraded. For example, if the equipment item is heavy, the toy is inclined forward and walks at a high speed while it becomes more liable to fall down. On the other hand, if the equipment item is light, the toy walks at a low speed while it can travel stably. In this manner, by selection of the equipment item, it is possible to change the quality of walking or running of the toy.

In the walking toy according to the invention, one of gears forming the gear train may be a climbing gear for revolving about a gear with which the climbing gear is to be engaged and which is closer to the drive gear, the climbing gear may be revolved to be disengaged from a gear, with which the climbing gear is to be engaged and which is closer to the output shaft, so as not to transmit rotation of the gear train to the output shaft when the lever is operated to wind the torsion coil spring.

In the above-described walking toy, the one of the gears forming the gear train of the gearbox is detached from the gear train so as not to transmit the rotation of the gear train to the output shaft when the lever is pushed down to wind the torsion coil spring. As a result, the legs do not flap and therefore it is possible to operate the toy placed on the floor surface with one hand. In other words, the torsion coil spring can be wound only by pushing down of the lever of the toy placed on the floor surface and this operation can be carried out by the infants.

In the walking toy according to the invention, each of the legs may have the bottom, i.e. a sole of a foot, with such a curved face that the curved face has a center of curvature in front, in a traveling direction, of a vertical axis passing through a center of swinging of the leg or has a center of curvature behind, in the traveling direction, the vertical axis, that the face of the bottom is partly in contact with the floor surface at a position in front of the vertical axis passing through the center of swinging of the leg or at a position behind the vertical axis, and that the face of the bottom is gradually separated from the floor surface and spaced from the floor surface behind the position of the contact or in front of the position of the contact, and the body may be inclined and the walking toy may move in a direction opposite to a direction in which the body is inclined.

In the above-described walking toy, the walking toy is necessarily inclined backward or forward due to the position of the center of gravity. Therefore, the walking toy moves in a direction opposite to the direction in which the body is inclined in the backward-inclined attitude or the forward-inclined attitude irrespective of positions of the gravity center position adjusting members. For example, if the body is inclined backward, even if the arms which function as the gravity center position adjusting member are stuck out backward, the walking toy travels forward. On the other hand, if the body is inclined forward, even if the arms are stuck out forward, the walking toy travels backward. Moreover, at this time, experimental results in which straight traveling property of running of the toy was higher and a traveling distance of the toy was longer were obtained. Furthermore, though a traveling direction is normally determined by the position of the center of gravity, the toy takes a strange traveling attitude in which it runs forward while its body is inclined backward. In this way, it is possible to achieve an interesting movement of the toy.

In the walking toy according to the invention, each of the legs may have the bottom, i.e. a sole of a foot, with such a curved face that the curved face has a center of curvature on the vertical axis passing through the center of swinging of the leg and that the face of the bottom is partly in contact with the floor surface at a position on the vertical axis passing through the center of swinging of the leg, and the body may stand upright.

In the above-described walking toy, when the position of the center of gravity is displaced from a position on the vertical axis passing through the center of curvature of the bottom of the leg, the walking toy moves in a direction in which the position of the center of gravity is displaced. In other words, the walking toy moves in a direction in which the body is inclined.

In the walking toy according to the invention, each of the legs may include a leg member to be swung in the forward/backward direction by the gearbox and a foot member which is detachably attached to a lower end of the leg member and has the bottom, and each of the foot members may be replaceable.

In the above-described walking toy, because the foot members are replaceable, it is possible to easily change the movement of the toy. For example, by replacing the foot members, it is possible to change a characteristic of the movement into stepping in place, traveling only forward, traveling only backward, moving quickly, or moving slowly without changing the toy main body.

The walking toy according to the invention may be formed as a walking toy set including the walking toy. To put it concretely, the walking toy set may include any one of the above-described walking toys and a track board having a track protruding from the floor surface. The track may be disposed between the paired legs of the walking toy in such a manner that the legs are positioned astride the track of the track board and the walking toy may be allowed to travel along the track.

Alternately, a walking toy set may include the plurality of walking toys and a track board having a plurality of tracks protruding from the floor surface. Each of the tracks may be disposed between the paired legs of each of the plurality of walking toys in such a manner that the legs are positioned astride each of the tracks of the track board and the plurality of walking toys may be simultaneously allowed to start traveling along the tracks to compete against each other.

In the walking toy according to the invention, the movement, the traveling, and stability of the toy are different depending on differences in adjustment of the positions of the gravity center position adjusting members and selection of the equipment item, e.g., difference in combination of the equipment items which are different in weight and shape. Therefore, by playing with the walking toys in combination with the track board having the rails, it is possible to cause the walking toy to compete against other walking toys on the walking speed under the same traveling condition.

BRIEF DESCRIPTION OF THE DRAWINGS

FIG. 10 is a conceptual diagram showing an example of combinations of arms, equipment items, foot members, and the like;

DETAILED DESCRIPTION OF THE INVENTION

Figure 1:
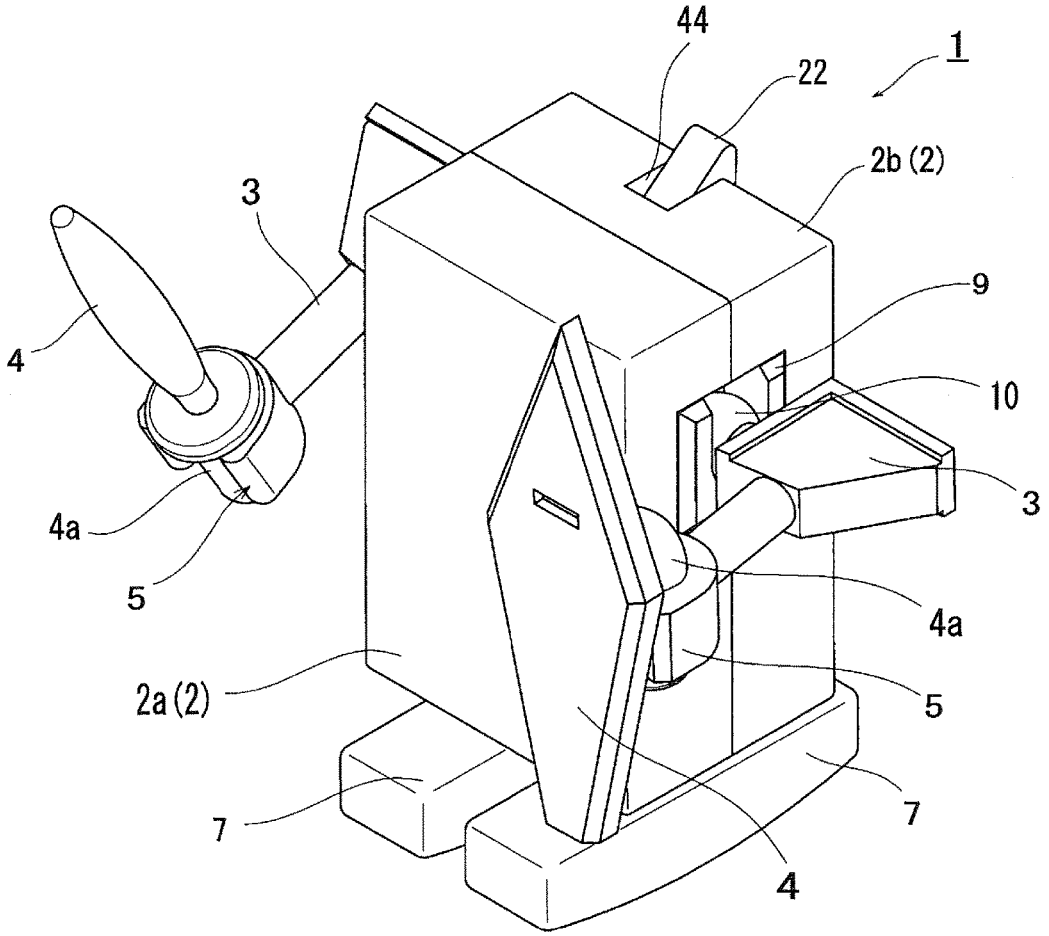
FIG. 1 is a perspective view showing an embodiment of a walking toy according to the present invention.

A detailed description will hereinafter be given of a structure of the present invention based on an embodiment shown in the drawings.

FIGS. 1 to 6 show an embodiment of a walking toy according to the invention. The walking toy 1 mainly includes a gearbox 8 driven by a torsion coil spring 25, paired leg members 6 and paired foot members 7 moved alternately forward and backward by the gearbox 8, a body 2 in which the gearbox 8 and the leg members 6 are mounted, and arms 3 and equipment items 4 as gravity center position adjusting members for adjusting a position of a center of gravity of the walking toy 1 by adjusting positional relationships with the body 2.

The body 2 is a portion serving as a main body of the walking toy 1, formed by injection molding of plastic, for example, and having a face, a trunk, or the like of an arbitrary character or an animal carved or printed on it.

The body 2 is formed by two pieces 2*a* and 2*b* separated in a forward/backward direction, for example. The two pieces 2*a* and 2*b* are fitted with each other, with the gearbox 8 and bearings 9 for supporting the paired leg members 6 and the paired arms 3 so as to allow them to move housed therebetween, and integrated with each other by use of fastening screws 20.

At a center of a back face, i.e., a back side of the body 2, a long groove 44 which is long in a vertical direction and which allows a lever 22 of the gearbox 8 to stick out and move up and down is formed. Thus, it is preferable that the lever 22 is provided at a center in a left/right direction of the body 2. In some cases, to put it concretely, depending on an overall design of the walking toy 1, for example, the lever 22 may stick out from a front face of the body 2.

Inside each of the pieces 2*a* and 2*b*, a recessed portion 46 for housing the gearbox 8 and retaining it in a substantially central position in the body 2 is formed. The recessed portions 46 are formed so as to fix the gearbox 8 in the central position in the body 2 when the pieces 2*a* and 2*b* are assembled so as to sandwich the gearbox 8 therebetween.

In order to allow the opposite leg-members 6 to swing, grooves 45 long in the forward/backward direction are formed in a bottom face, i.e., on a lower side of the body 2.

It is preferable that the gearbox 8 powered by the torsion coil spring 25 is set at the center in the left/right direction of the body 2. Furthermore, it is preferable that the lever 22 is provided at a center in a left/right direction of the gearbox 8.

The gearbox 8 includes the lever 22 in which one end 25*b* of the torsion coil spring 25 is caught, an output shaft 35 including crank mechanisms at opposite ends thereof, a speed change gear train provided between the lever 22 and the output shaft 35 to transmit rotation or a constant speed mechanism provided as necessary, and an outer frame 36 as a case for housing them.

The speed change gear train includes a gear 23 as a first gear formed at the lever 22, a second gear 27, a third gear 28, a fourth gear 32, and a fifth gear 34 provided to the output shaft 35 in the embodiment. The first gear formed at the lever 22 is referred to as a drive gear 23.

The lever 22 and the drive gear 23 may be in any forms, if they rotate synchronously. In some cases, the lever 22 and the drive gear 23 may be formed separately and fixed to the same rotary shaft.

In the gearbox 8 in the embodiment, a shaft 29 of the third gear 28 is supported in elongated holes 30 and 31 so that the third gear 28 can revolve about the second gear 27 in ranges of the elongated holes 30 and 31.

Therefore, when the lever 22 is pushed down and the torsion coil spring 25 is twisted, the third gear 28 is pulled up in a rotating direction of the second gear 27 due to rotation of the second gear 27, moves in the elongated holes 30 and 31, and is disengaged from the fourth gear 32. As a result, a rotary motion in pushing down the lever 22 stops being transmitted at the third gear 28 and is not transmitted to the fourth gear 32 and the fifth gear 34. Therefore, the output shaft 35 and, as a result, the leg members 6 do not move.

In other words, when a user pushes down the lever 22 to wind up the torsion coil spring 25, the leg members 6 do not move and therefore the user can carry out the pushing-down operation of the lever 22 while keeping the walking toy 1 placed on the floor surface.

The second gear 27 includes a pinion 27*a* engaged with the drive gear 23 formed at the lever 22, a wheel 27*b* disposed coaxially with the pinion 27*a*, and a shaft 26. The third gear 28 includes a pinion 28*a* engaged with the wheel 27*b* of the second gear 27, a wheel 28*b* disposed coaxially with the pinion 28*a*, and the shaft 29. The fourth gear 32 includes a pinion 32*a* engaged with the wheel 28*b* of the third gear 28, a wheel 32*b* disposed coaxially with the pinion 32*a*, and a shaft 33.

Figure 4:
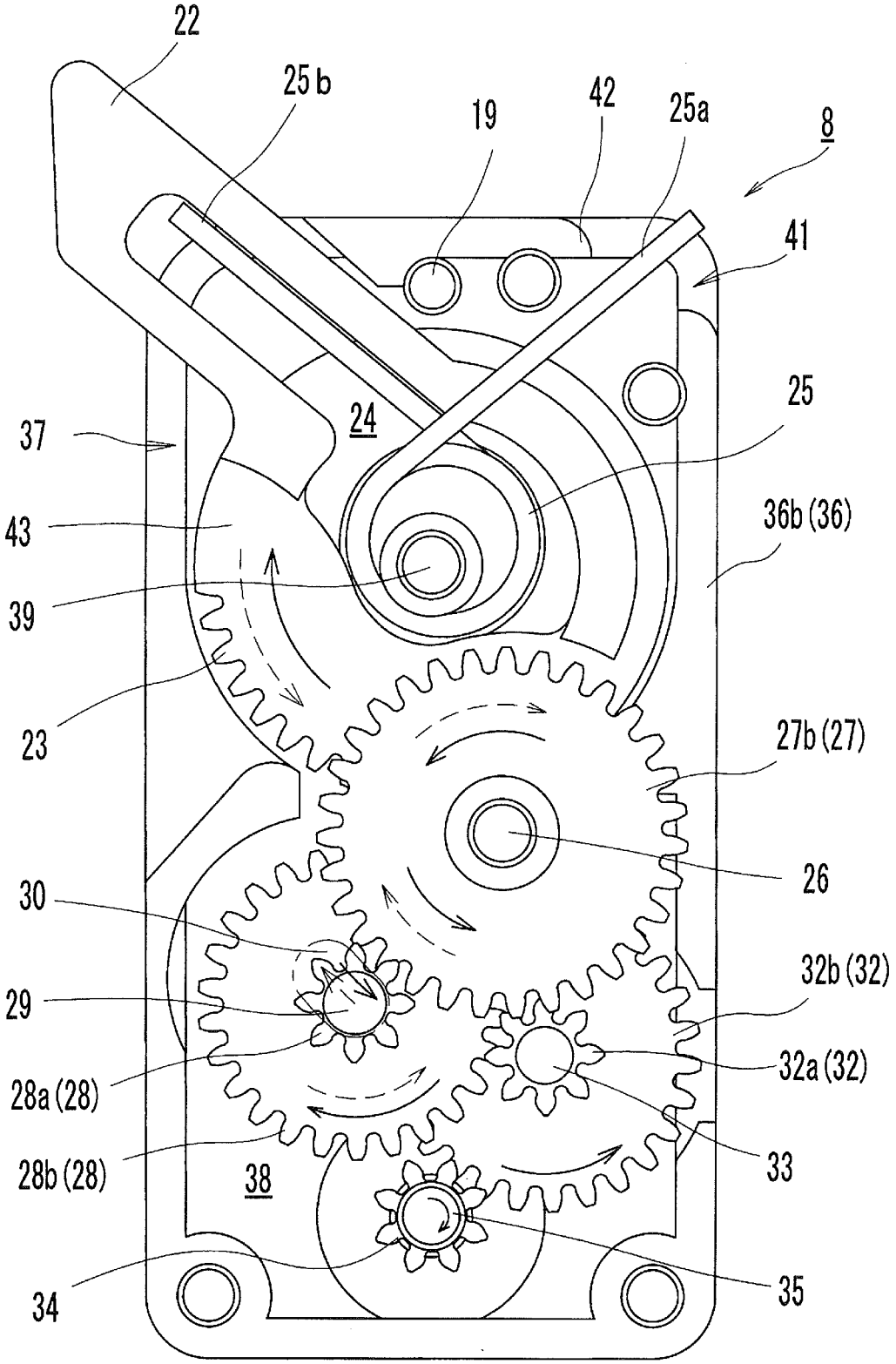
FIG. 4 is a side view showing a relationship between a lever and a gear train by removing one of frames of the gearbox in FIG. 3.
Figure 5:
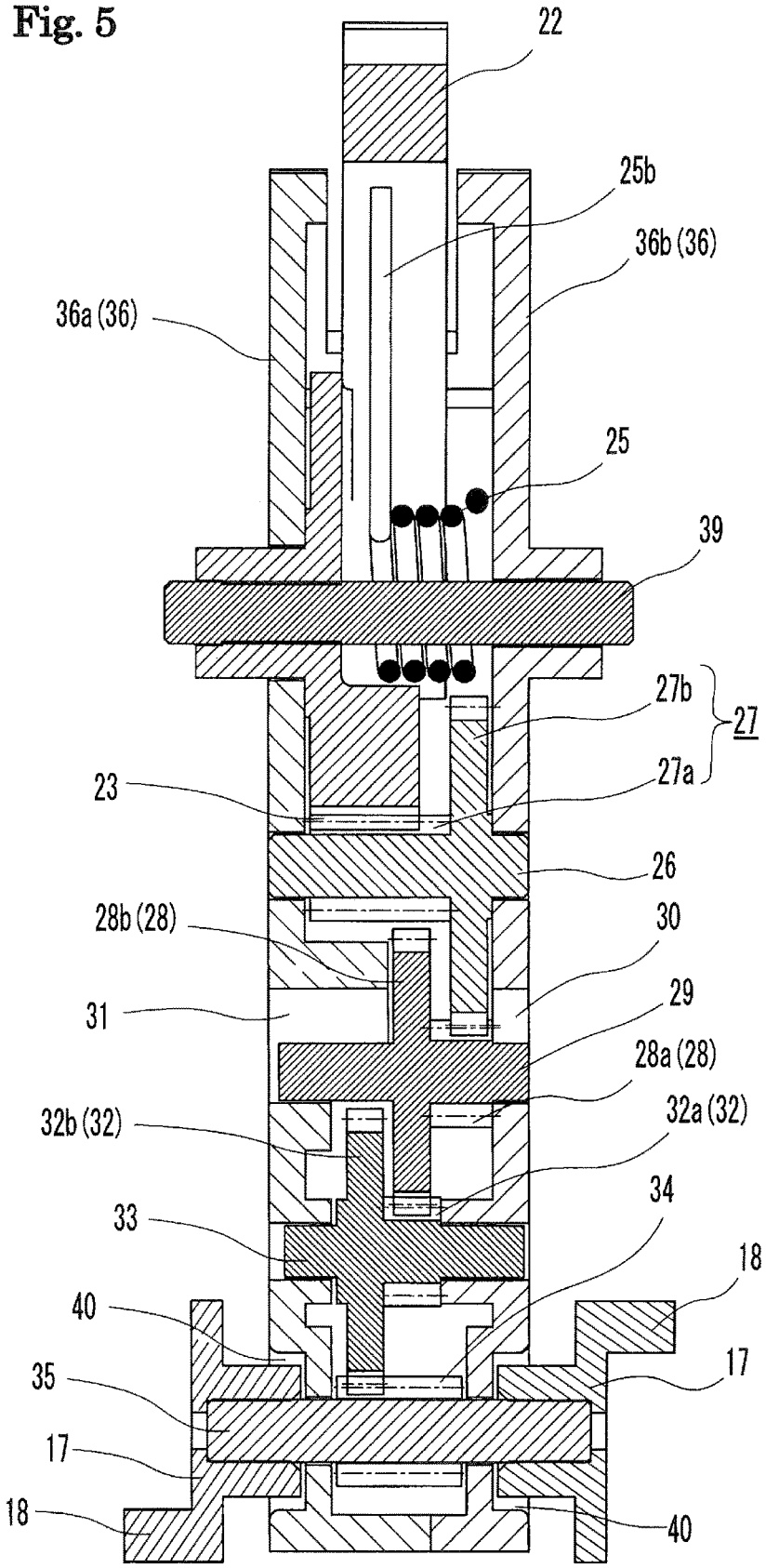
FIG. 5 is a sectional view of the gear train of the gearbox in FIG. 3 along a line passing through shafts of respective gears.
Figure 6:
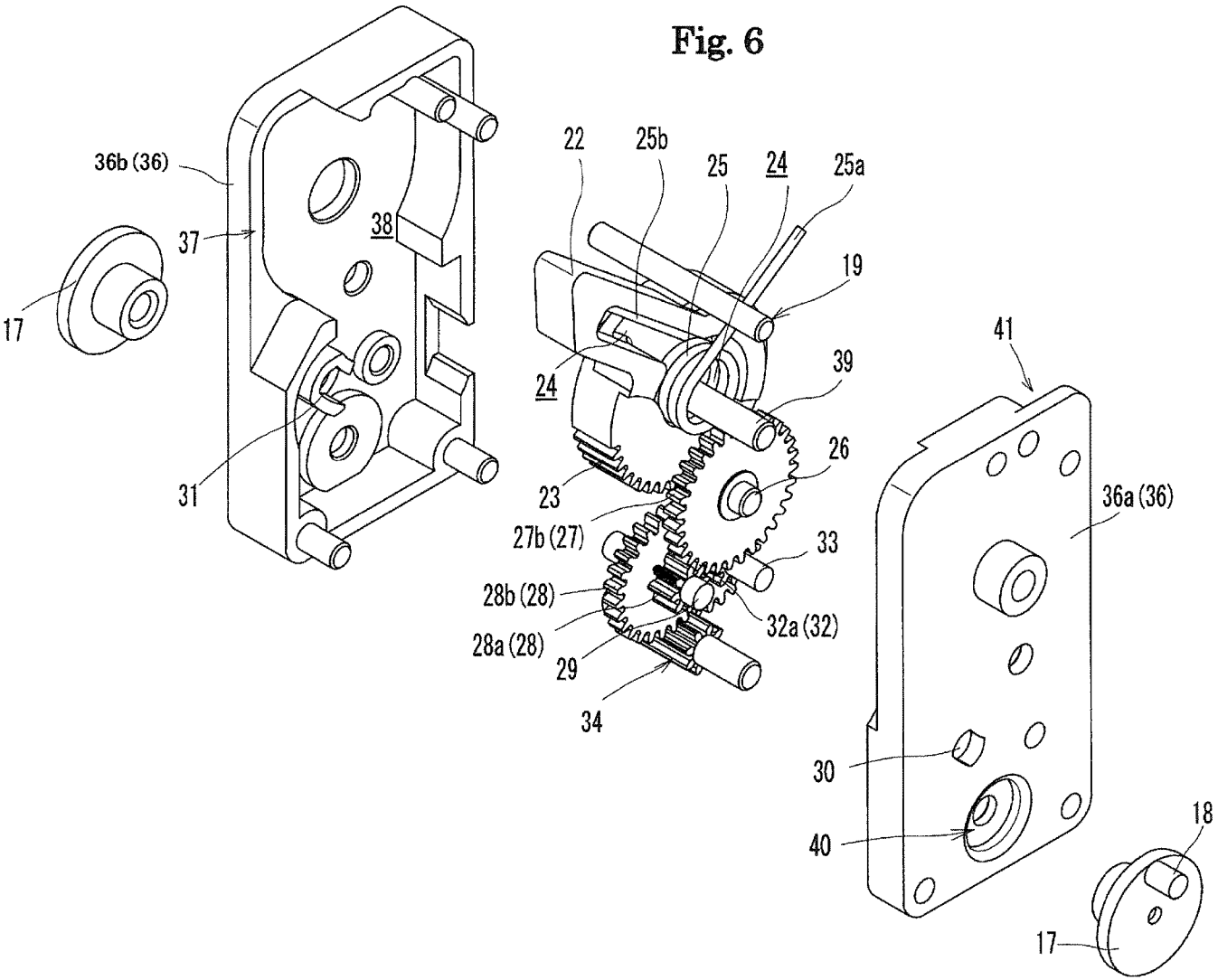
FIG. 6 is an exploded perspective view of the gearbox in FIG. 3.

In the embodiment, as shown in FIGS. 4 to 6, the lever 22 includes, at a center of its rotation, a disc portion 43 having the drive gear 23 formed at a portion of its peripheral face. Inside the disc portion 43, a space 24 for housing the torsion coil spring 25 is formed. Therefore, the lever 22, the drive gear 23, and the torsion coil spring 25 are substantially disposed in one plane orthogonal to the center of rotation, which can reduce a thickness of the gearbox 8 in the left/right direction.

The lever 22 is rotatably supported between the left and right frames 36*a* and 36*b* by a shaft 39 passing through a center of the disc portion 43 in the left/right direction.

The torsion coil spring 25 is housed in the internal space 24 in the disc portion 43 and disposed around the shaft 39 passing through the internal space 24 in the left/right direction.

The torsion coil spring 25 has the one end 25*b* housed in the internal space 24 extending toward a tip end of the lever 22 to come in contact with the lever 22 and the other end 25*a* protruding from an opening 41 formed in the outer frame 36 surrounding the internal space 24 to come in contact with an edge 42 of the outer frame 36 defining the opening 41.

In this way, torsion is imparted to the torsion coil spring 25 between the lever 22 and the outer frame 36 of the gearbox 8 when the lever 22 is pushed down.

The outer frame 36 is formed by fitting the two frames 36*a* and 36*b* with each other and separated into left and right at a center.

The lever 22 is supported to be able to swing in a vertical range of a vertically-long opening 37 formed at a central portion of a back side of the outer frame 36 along a mating face of the left and right frames 36*a* and 36*b*. At the disc portion 43 of the lever 22, the drive gear 23 is formed through a slightly greater angle than the swinging range of the lever 22.

The crank mechanisms are provided to the opposite ends of the output shaft 35 of the gearbox 8. Each of the crank mechanisms includes a disc 17 corresponding to a crank arm and a crank pin 18 provided at a position displaced from a center of rotation of the disc 17. The crank mechanisms are housed in recessed portions 40 formed on outer sides of the outer frame 36 of the gearbox 8 with the discs 17 fitted over the opposite ends of the output shaft 35 protruding to an outside of the gearbox 8.

The respective crank pins 18 of the discs 17 disposed on left and right sides of the gearbox 8 are attached at angles, which are displaced 180° from each other, to be engaged with vertically-elongated holes 16 in the paired leg members 6 disposed along the gearbox 8. Therefore, the left and right leg members 6 are forcibly swung in opposite directions from each other, i.e., alternately forward and backward as the output shaft 35 rotates.

On the outer sides of the gearbox 8, the paired leg members 6 are mounted to be able to swing by use of pins 19 protruding in the left/right direction. With the pin 19 fitted into a hole 14 at an upper portion of the leg member 6, the leg member 6 is supported to be able to swing forward and backward.

At a portion of each of the leg members 6 interfering with the shaft 39 of the lever 22, an arch-shaped elongated hole 15 which is laterally long in the forward/backward direction is formed. The shaft 39 and the bearing portion pass through the elongated hole 15 to thereby prevent the leg member 6 and the shaft 39 from interfering with each other.

A vertical elongated hole 16 is formed at a portion of each of the leg members 6 intersecting with the crank pin 18 so that the crank pin 18 is fitted and engaged in the elongated hole 16 in the forward/backward direction. Therefore, when the disc 17 rotates, the crank pin 18 drives the leg member 6 forward and backward while moving in a longitudinal direction in the elongated hole 16 of the leg member 6.

Figure 2:
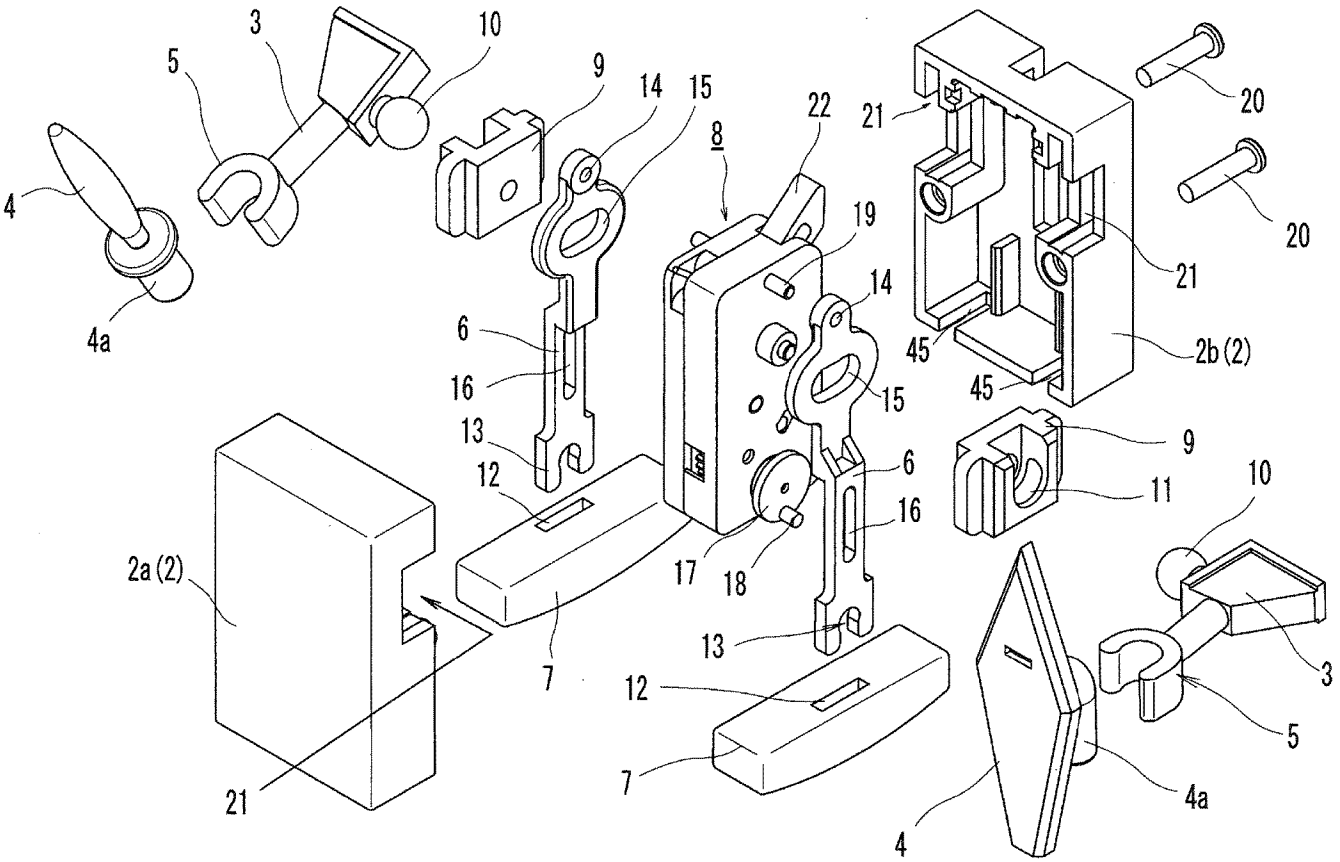
FIG. 2 is an exploded perspective view of the walking toy in FIG. 1.
Figure 3:
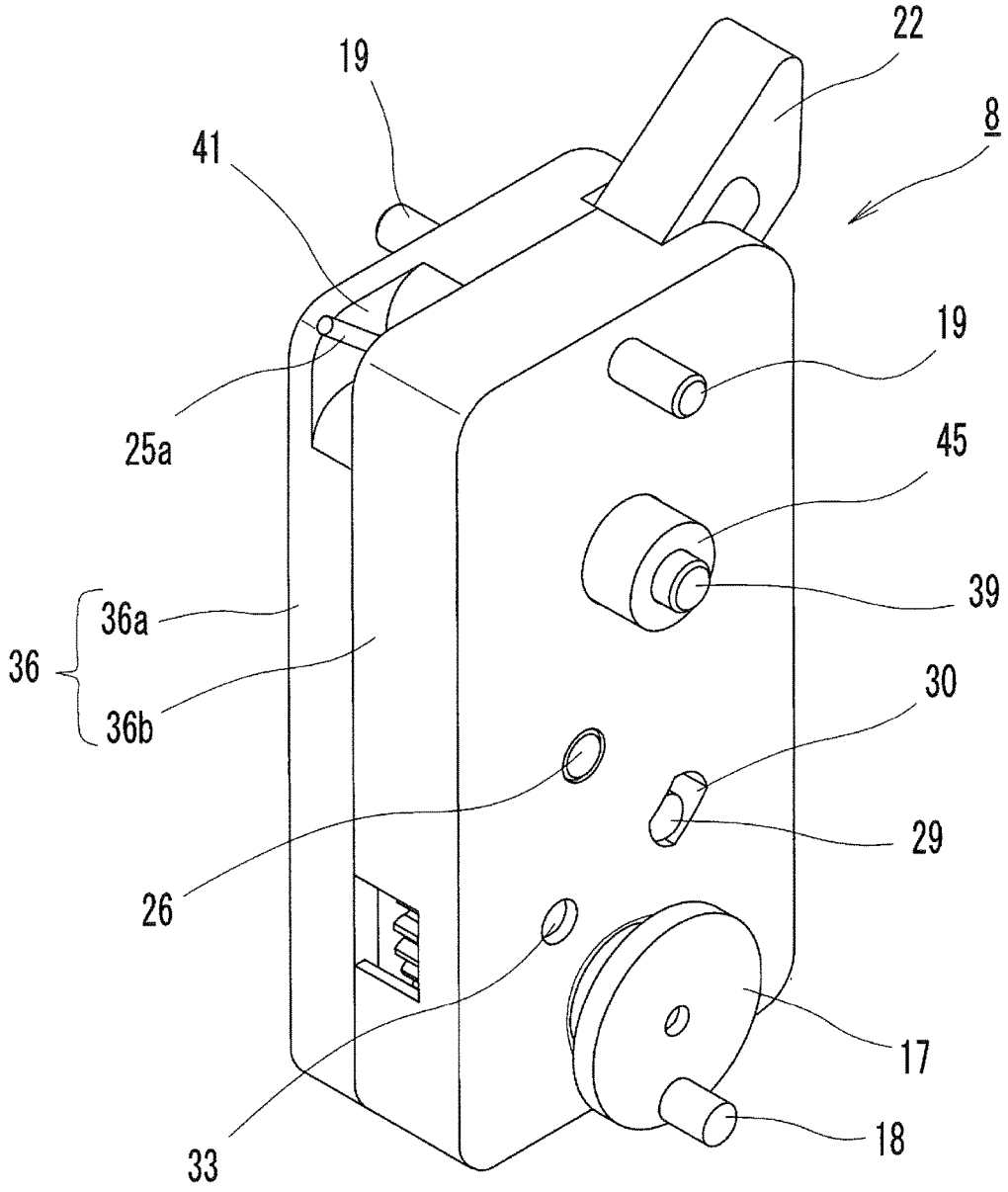
FIG. 3 is a perspective view showing an external appearance of a gearbox of the walking toy according to the invention.

At a lower end of each of the leg members 6, the foot member 7 is provided. The leg member 6 and the foot member 7 may be formed integrally. In the embodiment, however, the leg member 6 and the foot member 7 which are separate members are assembled and integrated with each other. For example, as shown in FIG. 2, a bifurcated connecting portion 13 is formed at the lower end of the leg member 6 and the foot member 7 is connected to the leg member 6 to be able to swing and to be detachable by inserting the connecting portion 13 of the leg member 6 into a groove 12 formed in the foot member 7 and causing the connecting portion 13 to pinch a shaft (not shown) provided in the groove 12 and crossing the groove 12. In this way, it is easy to replace only the foot members 7.

Figure 8A:
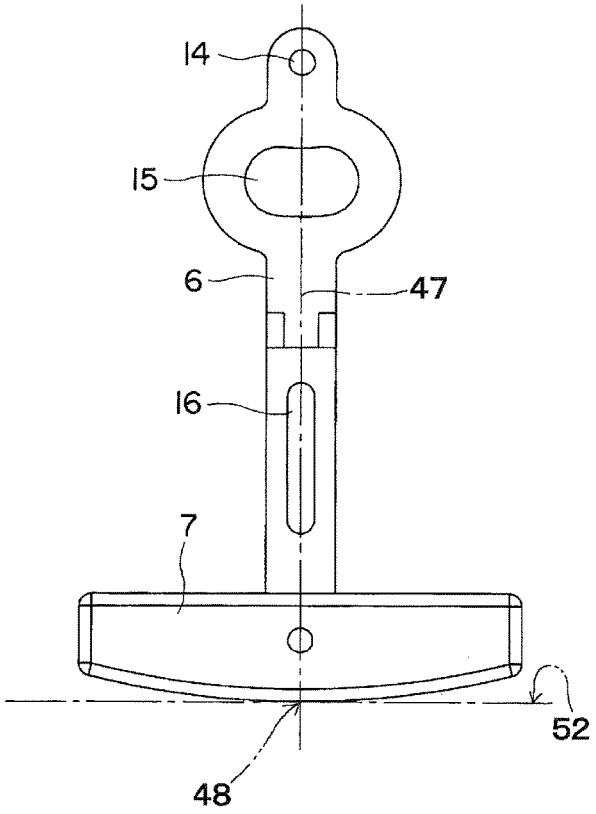
FIG. 8A is a side view showing an embodiment of a leg member and a foot member.
Figure 8B:
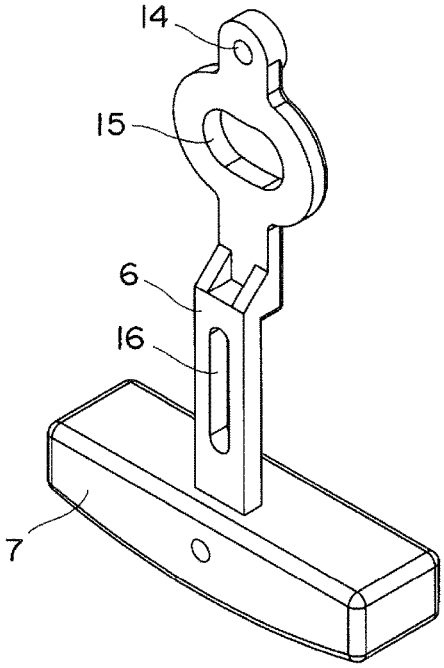
FIG. 8B is a perspective view showing the embodiment of the leg member and the foot member.

Each of the foot members 7 has a face (hereafter referred to as a bottom) which is in contact with a floor surface 52 and formed into a curved face curved gently in at least a swinging direction, i.e., the forward/backward direction. The floor surface 52 is constantly in contact with the opposite foot members 7 and the walking toy 1 can stand upright by using the opposite leg members 6 and the opposite foot members 7. For example, as shown in FIGS. 8A and 8B, each of the foot members 7 may have the bottom which is the curved face having a center of curvature on a vertical axis 47 passing through a center of swinging of the leg, i.e., a center of the hole 14, that is the curved face which is symmetric in the forward/backward direction with respect to the vertical axis 47, for example.

The curved face of the bottom may not be in the shape symmetric in the forward/backward direction with respect to the vertical axis 47 passing through the pin 19 or the hole 14. In some cases, the curved face may be in a shape asymmetric in the forward/backward direction with respect to the vertical axis 47 passing through the center of swinging of the leg.

Figure 9A:
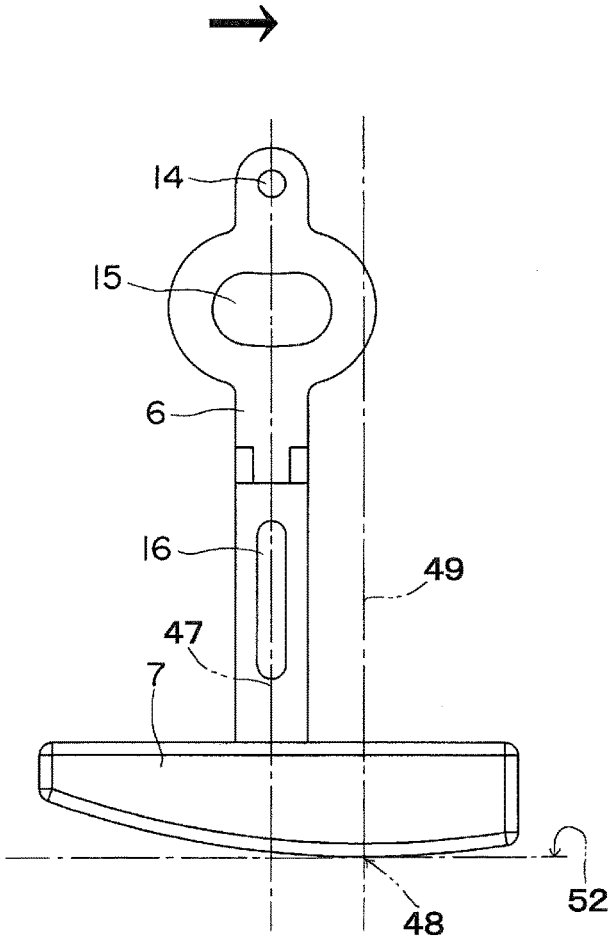
FIG. 9A is a side view showing another embodiment of the leg member and the foot member.
Figure 9B:
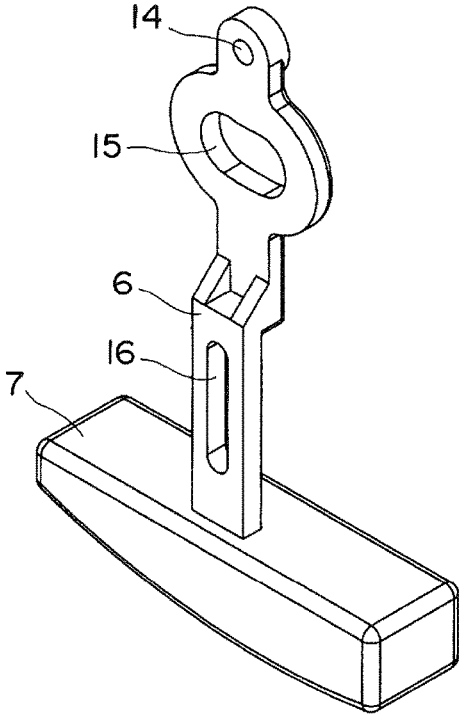
FIG. 9B is a perspective view showing the other embodiment of the leg member and the foot member.

For example, as shown in FIGS. 9A and 9B, each of the foot members 7 may have a bottom which is a curved face having a center of curvature on a vertical axis 49 passing through a position 48 in contact with a floor surface 52 and set in front, in a traveling direction, of the vertical axis 47 passing through a center of swinging of a leg, i.e., a center of a hole 14. In other words, the foot member 7 may have the bottom which is such a curved face that the face of the bottom is in contact with the floor surface at the position 48 in front of the vertical axis 47 passing through the center of swinging of the leg and is gradually separated from the floor surface to be spaced from the floor surface behind the position 48 when the walking toy 1 stands upright. The position 48 in front of the vertical axis 47 is on the vertical axis 49. In this case, a center of gravity of an entire body is behind the position 48 where the faces of the bottoms are in contact with the floor surface when the walking toy 1 stands upright and therefore the body 2 is necessarily inclined backward.

The gravity center position adjusting members are disposed on opposite sides of the body 2. For example, in the embodiment, the gravity center position adjusting members each of which includes the arm 3 and the equipment item 4 attachable to the arm 3 are disposed on the opposite sides of the body 2.

Each of the arms 3 is connected to the body 2 by use of a spherical joint so that is can be rotated and inclined. For example, a spherical shaft portion 10 is provided to the arm 3, the bearing 9 having a spherical recessed portion 11 is provided to the body 2, and the arm 3 and the body 2 are connected to each other so that the shaft portion 10 and, as a result, the arm 3 can be inclined or rotated by sliding of the spherical faces on each other.

The bearing 9 is formed by a rectangular block having flange portions protruding forward and backward, fitted into a grooved recessed portion 21 formed along division faces of the body pieces 2*a* and 2*b* separated forward and backward, and fixed while prevented from being detached in the left/right direction of the body 2 by fitting of edge portions of the bearing 9 into the groove portions of the recessed portion 21 when the body pieces 2*a* and 2*b* are connected by use of the screws 20.

The arm 3 does not necessarily have to be connected to the body 2 to be able to turn by the spherical bearing. The arm 3 may have a uniaxial joint or an orthogonal biaxial joint so as to achieve forward/backward or leftward/rightward movements or a combination of them. Arms 3 may be made of material which can be deformed arbitrarily and plastically, e.g., polyvinyl chloride, a shape-memory alloy, and a shape-memory resin and may be deformed to thereby move the center of gravity forward and backward or sideways. In this case, it is unnecessary to provide joint structures between the arms 3 and the body 2.

Each of the arms 3 has, at its tip end, a grasping portion 5 to which the equipment item 4 functioning as the gravity center position adjusting member by cooperating with the arm 3 is detachably attached. The grasping portion 5 is not limited to specific shape and structure. In the embodiment, because a portion 4*a* of the equipment item 4 to be attached to the arm 3 (referred to as the attached portion 4*a*) is formed into a rod shape, the grasping portion 5 is in a shape of a C-shaped semicylinder, for example. With the attached portion 4*a* of the equipment item 4 fitted in an axial direction, the grasping portion 5 can support the equipment item 4 in such a manner that the equipment item 4 can be detached.

Here, the equipment item 4 is for adjusting the center of gravity and, at the same time, serves as a prop for imparting a plot to a character of the walking toy 1. For example, if the character of the walking toy 1 is a fighter, the walking toy 1 holds a sword or a spear in its right hand and a shield in an arbitrary shape in its left hand. It is needless to say that the character and the equipment items are not especially limited to these examples. If the equipment item 4 has the attached portion 4*a* which can be detachably attached to the grasping portion 5, it is possible to attach equipment items of various structures, shapes, and styles according to the character of the walking toy 1.

Although the arm 3 and the equipment item 4 as the gravity center position adjusting member can be detachably attached to each other and the equipment item 4 can be replaced in the embodiment, the arm 3 and the equipment item 4 may be formed integrally and the arm 3 itself may be detachably attached to the body 2 in some cases.

According to the walking toy formed as described above, by selecting presence or absence of the equipment item 4, replacing the equipment item 4 with another equipment item 4 which is different in size and shape, and changing a position of each of the equipment items 4 by turning the arm 3, it is possible to freely set a walking direction of the walking toy 1.

For example, according to the walking toy 1 including the foot members 7 on which the walking toy 1 can easily stand upright as shown in FIGS. 8A and 8B, i.e., according to the walking toy 1 including the foot members 7 each having the bottom formed by the curved face symmetric in the forward/backward direction with the center of curvature on the vertical axis 47 passing through the hole 14 as the center of swinging and the elongated hole 16, the walking toy 1 moved in place when it was moved without holding equipment items 4 in its opposite arms 3 (case 1) while the walking toy 1 traveled forward when it kept lifting its arms 3 holding the equipment items 4 up in front of it (case 2). The forward travel in case 2 was the travel during which a direction was changed.

The walking toy 1 traveled backward when it kept lifting its opposite arms 3 holding equipment items 4 up behind it (case 3) while the walking toy 1 turned in place in a small radius when it raised its opposite arms 3 holding equipment items 4 right above it (case 4).

The walking toy 1 moved backward, though equipment items 4 were in front, when the body 2 was inclined backward so as to bring the equipment items 4, held in the arms 3 put in front of the walking toy 1, in contact with the floor surface (case 5). The walking toy 1 turned in a small radius when a large equipment item 4 held in one of the arms 3 was brought in contact with the floor surface at a very close position to the grasping portion 5 (case 6). The walking toy 1 turned in a large radius when the large equipment item 4 held in one of the arms 3 was brought in contact with the floor surface at its tip end away from the grasping portion 5, that is, at a position away from the foot members 7 (case 7). The walking toy 1 is believed to turn about a point where the equipment item 4 is in contact with the floor surface when the contact point was close to the body as in case 6 and to turn in the large radius when the contact point is far away from the body as in case 7, because the walking toy 1 cannot make a sharp turn in this case.

The walking toy 1 turned backward in a large radius, though an equipment item 4 was in front, when the body was inclined backward so as to bring the equipment item 4 held in one of the arms in contact with the floor surface (case 8). The walking toy 1 traveled forward when large equipment items 4 held in the opposite arms put in front were brought in contact with the floor surface (case 9). The forward travel in case 9 was different from that in case 2 in that a direction was not changed during the travel.

In other words, according to the walking toy 1 including the foot members 7 each having the bottom formed by the curved face symmetric in the forward/backward direction with respect to the vertical axis passing through the center of swinging, a moving direction is determined by positions of the arms 3 when the equipment items 4 are not attached and the moving direction is determined by positions of the equipment items 4 when the equipment items 4 are attached. In other words, the walking toy 1 moves in a direction in which the body 2 is inclined. When equipment items 4 are in contact with the floor surface and the body 2 is inclined in an opposite direction from positions of the equipment items 4, the walking toy 1 moves in a direction in which the body 2 is inclined irrespective of size and weight of the equipment items 4.

By replacing the foot members 7, it is possible to change the movement of the walking toy 1. For example, according to the walking toy 1 including the foot members 7 on which the body 2 is likely to be inclined backward as shown in FIGS. 9A and 9B, i.e., according to the walking toy 1 including the foot members 7 each having the bottom which is the curved face in contact with the floor surface at the position 48 in front, in the traveling direction, of the vertical axis 47 passing through the hole 14 as the center of swinging and the elongated hole 16 and with a center of curvature on the vertical axis 49 passing through the position 48 in the upright attitude, the walking toy 1 walks forward irrespective of positions of the arms 3. Such a movement of the walking toy 1 was an unexpected movement. Furthermore, the movement of the walking toy 1 is a very unique movement and has not been yet realized by a conventional toy with only two legs.

This is believed to be caused by a clearance formed between the bottom of each of the foot members 7 and the floor surface on the vertical axis passing through a center of the hole 14 which is the center of swinging of the leg member 6. Because the clearance gradually increases in size toward a back end side, the body 2 is necessarily inclined backward and the walking toy 1 stands with a back side of each of the foot members 7 in contact with the floor surface. This is believed to cause the walking toy 1 to put its foot forward.

The walking toy 1 exhibits a phenomenon in which the walking toy 1 travels forward even if the center of gravity is moved backward in the traveling direction by sticking the arms 3 out backward (case 9), the phenomenon not exhibited by the walking toy 1 having the foot members 7 shown in FIGS. 8A and 8B.

Figure 12:
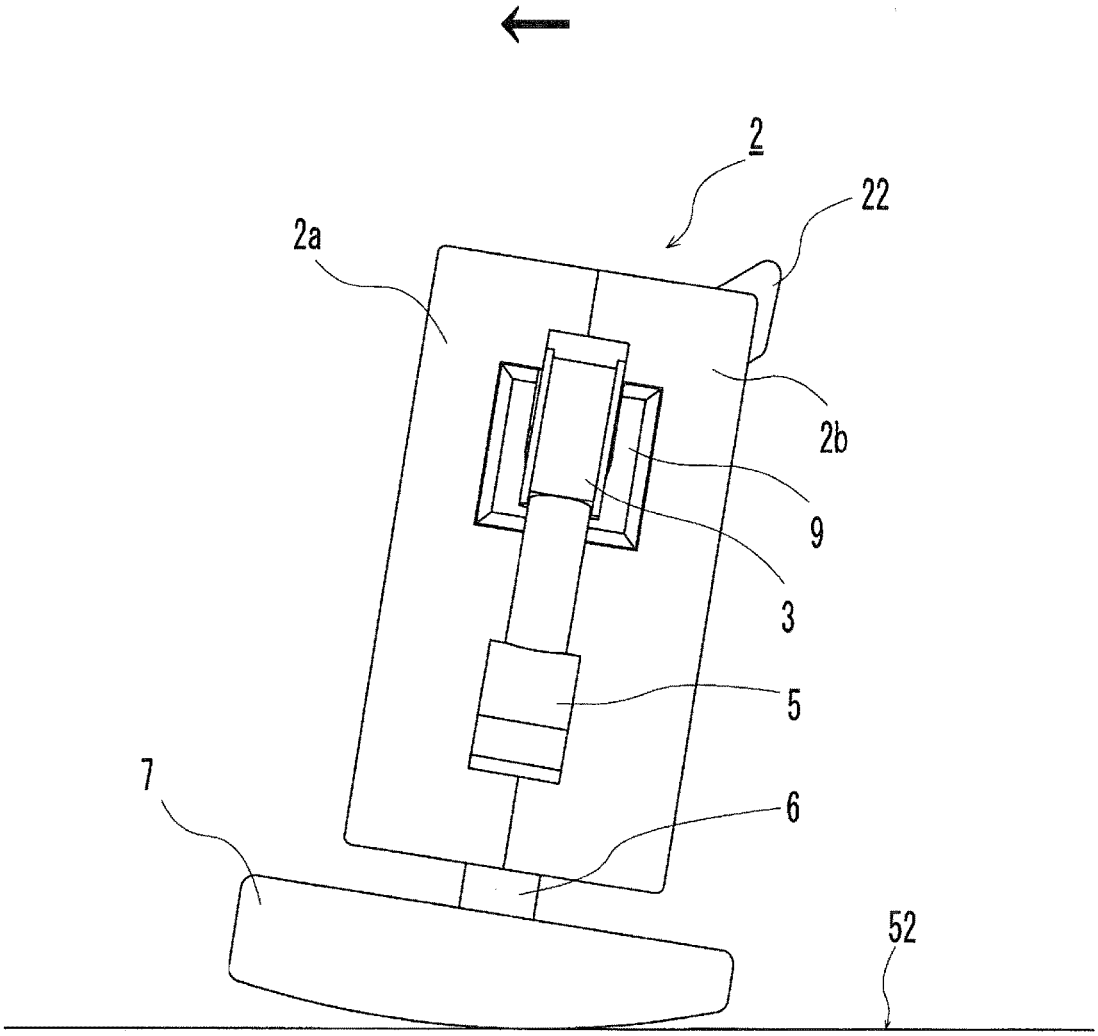
FIG. 12 is a side view of the walking toy in FIG. 1 which includes the legs shown in FIGS. 9A and 9B and is inclined backward.
Figure 13:
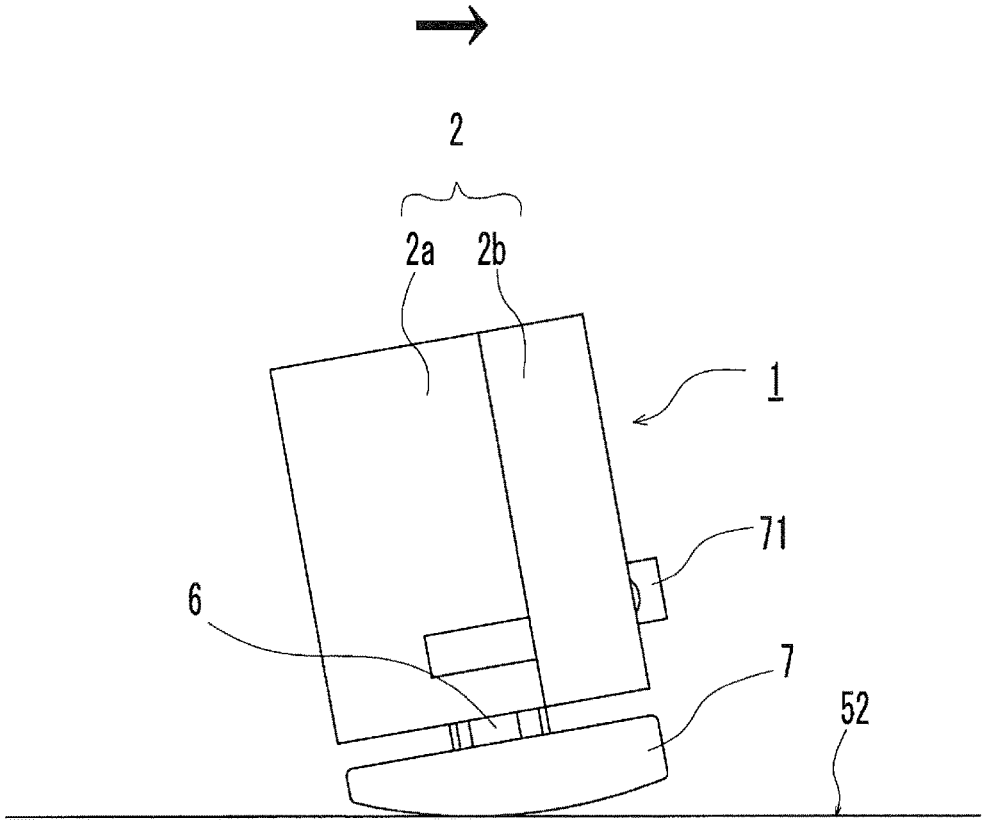
FIG. 13 is a side view showing another embodiment of the walking toy according to the invention which includes the legs shown in FIGS. 9A and 9B and is inclined forward.

Normally, the traveling direction of the walking toy is determined by the position of the center of gravity. However, the walking toy 1 takes a strange traveling attitude in which it runs forward while its body 2 is inclined backward. In this way, it is possible to achieve unconventional interesting movements of the toy. Moreover, at this time, unexpected experimental results in which straight traveling property of running of the toy was higher and a traveling distance of the toy was longer than those of the toy in FIG. 1 were obtained. That is, the walking toy 1 moves in a direction opposite to the direction in which the body 2 is inclined. In this manner, as shown in FIG. 12, if the body 2 is inclined backward, it is possible to achieve an interesting movement of which the walking toy 1 travels forward in the backward-inclined attitude. On the other hand, as shown in FIG. 13, if the body 2 is inclined forward, it is possible to achieve a movement of which the walking toy 1 travels backward in the forward-inclined attitude. In other words, the walking toy 1 can perform a dance such as the backslide, i.e., the moonwalk. The arrow in each figure indicates the traveling direction of the walking toy 1.

Figure 11A:
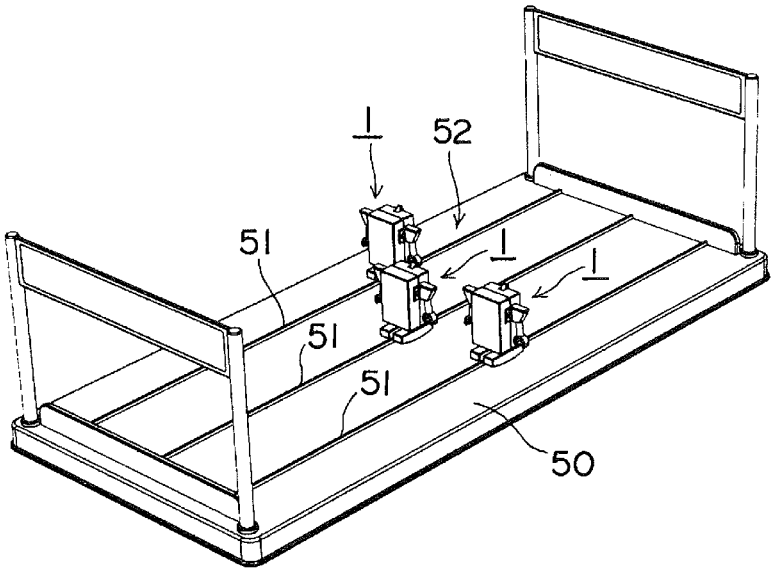
FIG. 11A is a perspective view showing an example of how to play with the walking toys.

The present inventors conducted an experiment in which toys were caused to walk simultaneously on a track board as shown in FIG. 11A, the toys including two toys having the foot members 7 each with the bottom formed by the curved face symmetric in the forward/backward direction shown in FIGS. 8A and 8B, and more specifically, the toy holding a large equipment item 4 in one of its arms and in contact with a floor surface at a tip end away from a grasping portion 5 (case A) and the toy holding a large equipment item 4 in one of its arms and in contact with the floor surface at a very close position to a grasping portion 5 (case B) and a toy having the foot members 7 on which the toy was likely to be inclined backward shown in FIGS. 9A and 9B, and more specifically, the toy keeping its opposite arms 3 holding equipment items 4 up behind it to thereby incline its body 2 backward (case C).

As a result of the experiment, it was the toy in case C that reached an end the earliest, the toy in case B reached the next, and the toy in case A reached a position near the end the last but could not reach the end.

It is needless to say that the foot members 7 are not especially limited to those described above. By changing the shape of the curved face of the sole of each of the feet, it is possible to achieve various movements such as stepping in place, traveling forward, traveling backward, traveling fast, and traveling slowly.

In any of these cases, because the opposite arms 3 are disposed bilaterally symmetrically with respect to the body 2, the walking toy 1 is balanced in the left/right direction like a balancing toy and therefore the walking toy 1 is less likely to fall down during walking. If the equipment items 4 are excluded, the position of the center of gravity of the entire toy including the opposite arms 3 and the body 2 is at the center in the left/right direction of the walking toy 1. Therefore, by displacing positions of the opposite arms 3 from each other, it is possible to delicately adjust displacement of the position of the center of gravity to thereby finely adjust the change in the movement.

Because the lever 22 is used as a winding device for the gearbox 8 driven by the torsion coil spring 25 and also because the lever 22 is disposed at the center in the left/right direction of the body 2, the position of the center of gravity of the walking toy 1 excluding the equipment items 4 is substantially at the center and therefore it is easy to change the position of the center of gravity by changing the equipment items 4. In other words, if an equipment item 4 is replaced with another equipment item 4 which is different in weight and shape, the position of the center of gravity is displaced by the equipment item 4 and, as a result, a walking speed and a moving direction of the walking toy 1 are changed even in the same attitude.

For example, when a weapon such as a shield and a halberd is used as the equipment item 4 of the gravity center position adjusting member, the walking toy 1 is inclined forward and walks at a high speed while it becomes more liable to fall down, if the heavy weapon is held up in front.

On the other hand, if a light equipment item 4, i.e., weapon is held up in front, the walking toy 1 walks slowly while it can travel stably. In this manner, depending on which equipment item 4 is selected, the attitude, the traveling speed, and the tendency to fall down are different, which enables a plurality of walking toys 1 to compete against each other. In other words, competition play is possible.

Figure 7:
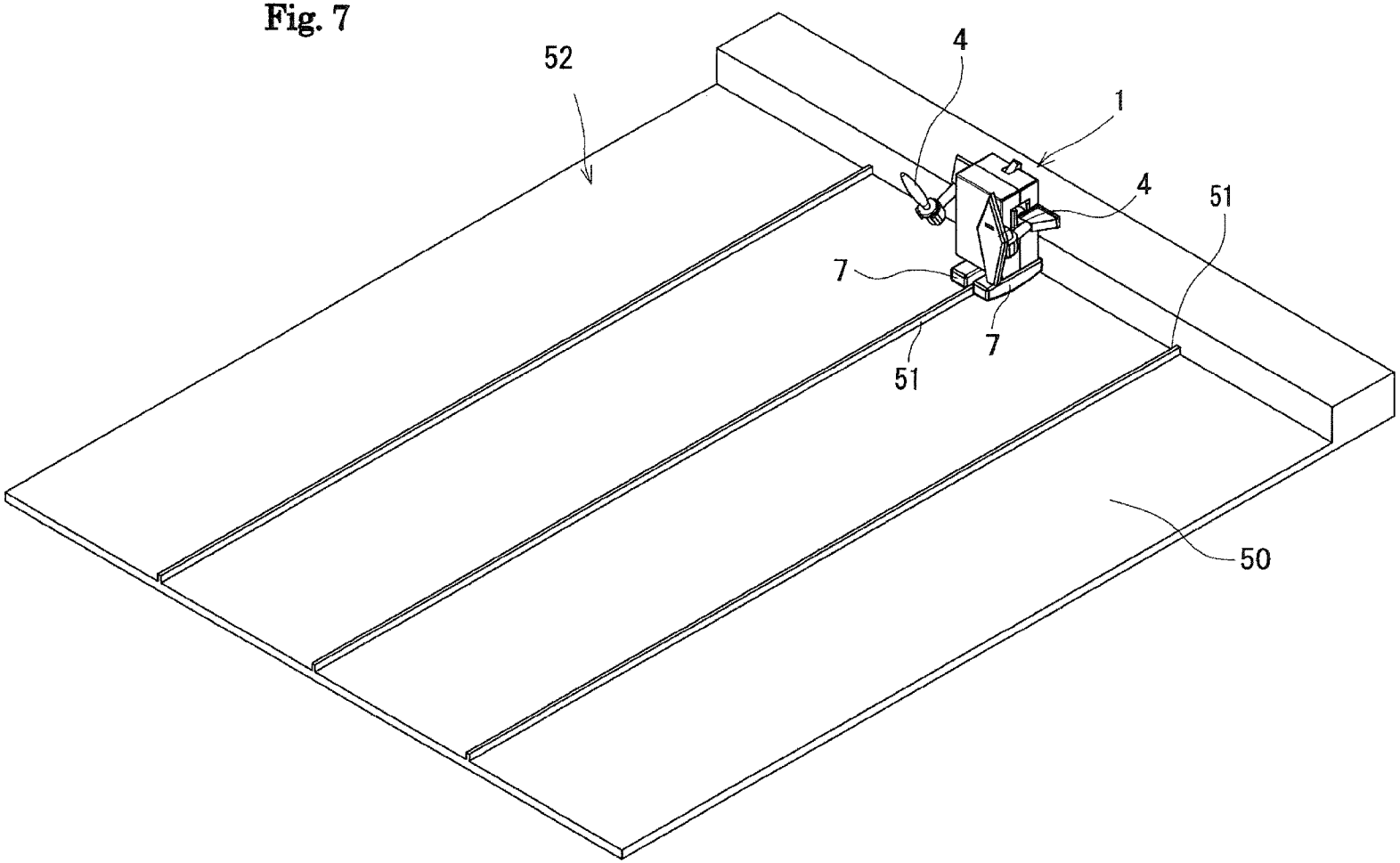
FIG. 7 is a perspective view showing a relationship between the walking toy according to the invention and a track board.
Figure 11B:
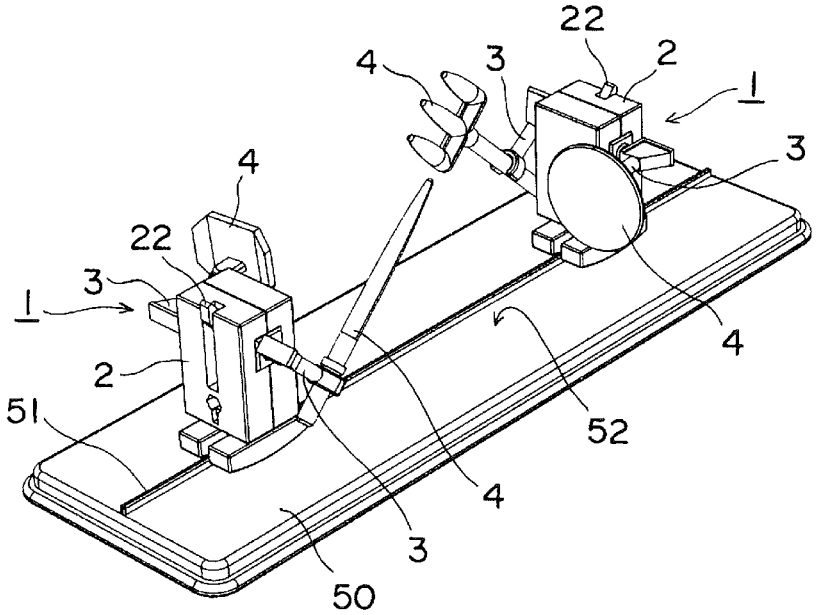
FIG. 11B is a perspective view showing another example of how to play with the walking toys.
Figure 11C:
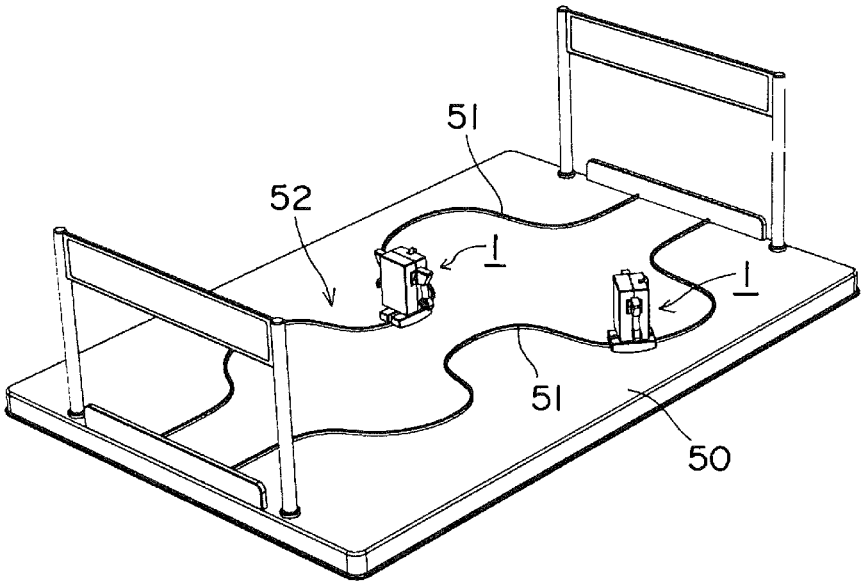
FIG. 11C is a perspective view showing yet another example of how to play with the walking toys.

Especially, as shown in FIGS. 7, 11A, and 11C, by playing with the toy(s) in combination with a track board 50 having a plurality of rails 51, it is possible to cause the walking toy 1 to compete against other walking toys 1 on the walking speed under the same walking condition. In other words, movement, running, and stability are different depending on difference in the equipment items 4 to be selected, i.e., a combination between the equipment items 4 which are different in weight and shape, which increases game elements.

If the left and right foot members 7 of the walking toy 1 are disposed astride the rail 51, the walking toy 1 can run or walk along the rail 51. Therefore, it is also possible to play by allowing the walking toy 1 to trace along the rail 51 or causing the walking toys 1 to compete against each other.

Figure 11D:
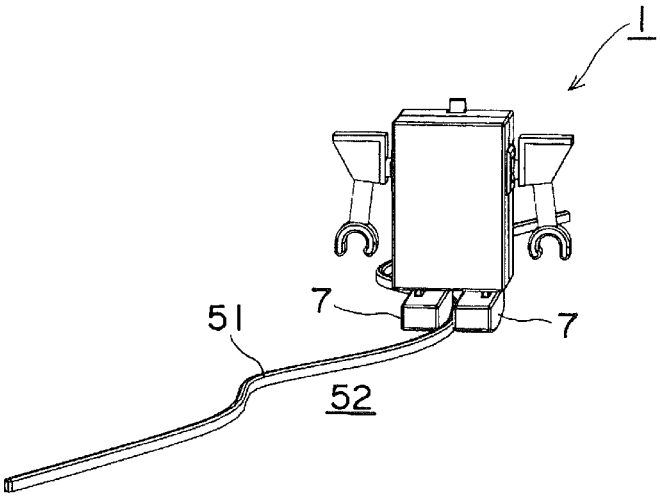
FIG. 11D is a perspective view showing still another example of how to play with the walking toy.

One of the examples of how to play with the walking toy(s) 1 is shown in FIG. 11D in which a flexible rail is bent arbitrarily and disposed on a floor surface and the walking toy 1 is allowed to run or walk along the rail.

Another example is shown in FIG. 11B in which the two toys are set to face each other on a track board 50 having a straight rail 51 and are allowed to move forward to thereby collide with each other and compete on which falls down first.

Another example is shown in FIG. 11C, in which the plurality of walking toys 1 chase each other back and forth on the track board 50 having the plurality of winding rails of different routes.

Figure 10:
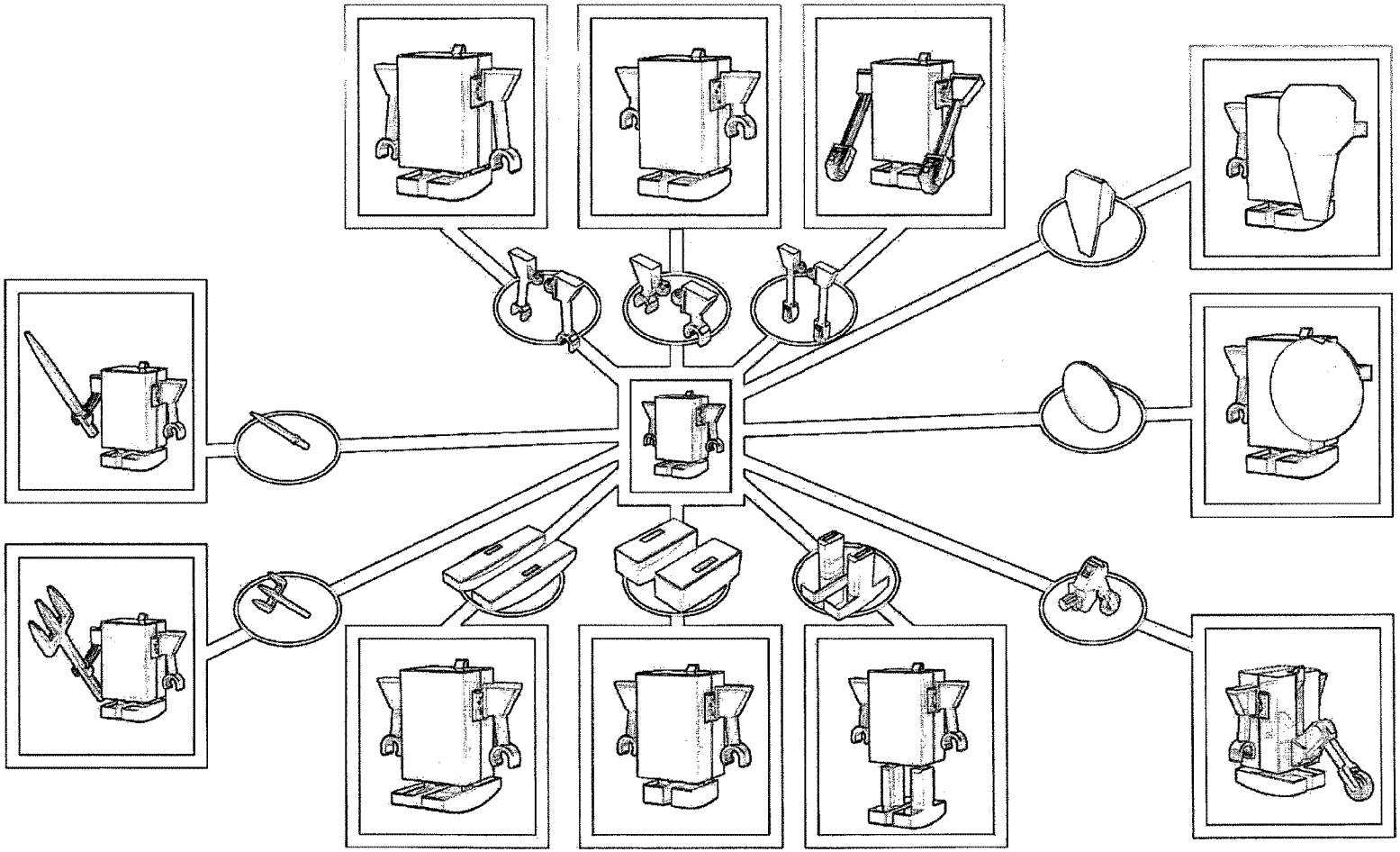

As an example, as shown in FIG. 10, if the equipment item 4, the foot members 7, and the arms 3 are replaceable, it is possible to impart a plot such as growing up or transfiguration of the character set for the toy by enabling upgrading of the weapon of the character, for example. In this case, accessories adapted to the character of the walking toy 1 are prepared and used to enhance the fun of the toy. Moreover, by replacing the equipment items 4 such as the weapons and other accessories to be held by the walking toy 1, it is possible to change quality of the movement of the walking toy 1.

Although the above-described embodiment is an example of preferred embodiments of the invention, the invention is not limited to it and can be changed and carried out in various ways without departing from the gist of the invention. For example, although the leg members 6 and the foot members 7 can be detached from each other and the foot members 7 can be replaced in the above-described embodiment, the invention is not especially limited to it. The leg members 6 and the foot members 7 may be connected to or molded integrally with each other and the foot members 7 with the leg members 6 may be replaced.

The foot members 7 may be formed as boots including portions for extending the leg members 6 so as to substantially increase lengths of legs when connected to the leg members 6 to thereby change looks and an external appearance of the character of the walking toy 1 from a body shape of an infant into a body shape of a boy or a girl and into a body shape of an adult.

Similarly, the arms 3 are not limited to those shown in the drawings but may be shorter arms or longer arms. In some cases, arms 3 may have rollers at tip ends thereof so as to bring the tip ends of the arms in contact with the floor surface to thereby prevent falling down in the forward direction.

Moreover, a body may have a fixing leg on a back side which has a roller and bends to thereby extend backwards to prevent falling down in the backward direction. In some cases, equipment items in various forms may be fitted into the grasping portions at the tip ends of the arms.

If the entire gravity center position adjusting member is attachable/detachable to and from the body 2 or if the equipment item 4 which is a part of the gravity center position adjusting member is attachable/detachable to and from the arm 3, accessories adapted to the character of the walking toy 1 may be prepared and used to enhance fun of the toy.

Furthermore, if a weight in a form of a doll standing on the floor surface is prepared and connected to the grasping portions 5 at the tip ends of the arms 3, the walking toy 1 turns around the doll and it is possible to replicate a movement of dancing.

Moreover, although the arms 3 and the equipment items 4 as the gravity center position adjusting members are respectively provided on the opposite sides of the body 2 in the embodiment, the equipment item 4 may be attached to one of the arms 3 in some cases or the arm 3 and the equipment item 4 may be provided on only one side in some cases. Furthermore, neither the arm 3 nor the equipment item 4 may be provided in some cases. In this case, the gravity center position adjusting member(s) may be provided at a center in the left/right direction of the body 2 or provided around the center of the body 2.

If the arms 3 and the equipment items 4 are provided on the opposite sides, it is possible to produce subtler movements by moving them independently of each other. For example, the moving speed increases when the opposite arms 3 and the opposite equipment items 4 are put forward or backward while the walking toy 1 turns in a small radius when the arms 3 and the equipment items 4 are put in opposite directions from each other.

Moreover, although the gearbox 8 driven by the torsion coil spring 25 is used in the embodiment, a gearbox driven by a direct-current motor may be used. For example, as shown in FIGS. 13 to 17, a gearbox 72 housing a direct-current motor 60 transmits rotation of a pinion gear 61 of a motor shaft, which is disposed along the vertical direction, to the output shaft 35 via a crown gear 62, a pinion gear 63 which is disposed coaxially with the crown gear 62 and rotates around a horizontal axis of rotation, a gear 64, a pinion gear 65 which is disposed coaxially with the gear 64, a gear 66, a gear 67 which are disposed coaxially with the gear 66, and a gear 68. As a result, the output shaft 35 is driven.

An outer frame 73 is formed by left and right frames 73*a* and 73*b* and a panel wall 73*c*. The panel wall 73*c* is disposed between the left and right frames 73*a* and 73*b*. The frame 73*a*, i.e. one of the frames forming the outer frame 73, includes a battery outer case 69 housing a battery 70. The outer frame 73 holds the direct-current motor 60 in the vertical direction between the panel wall 73*c* and an inside surface of the frame 73*a*.

Figure 14:
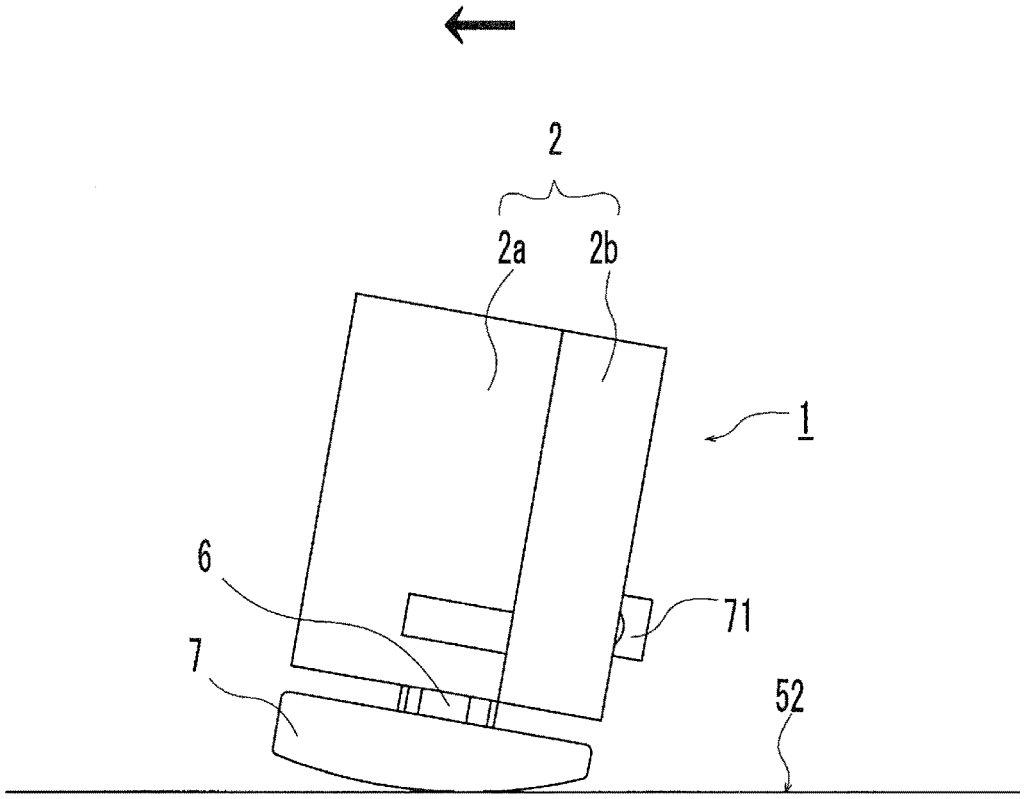
FIG. 14 is a side view showing another form of the walking toy in FIG. 13 which is inclined backward by changing a direction of the foot member.
Figure 15:
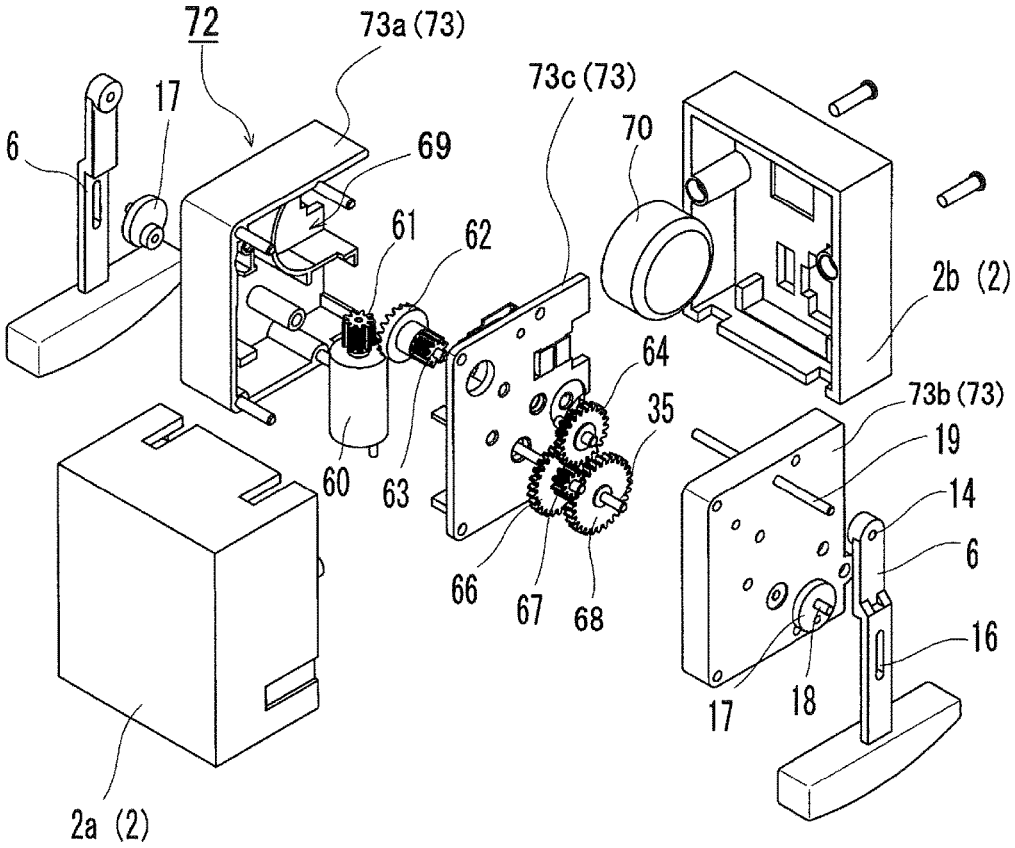
FIG. 15 is an exploded perspective view of the walking toy in FIG. 13.
Figure 16:
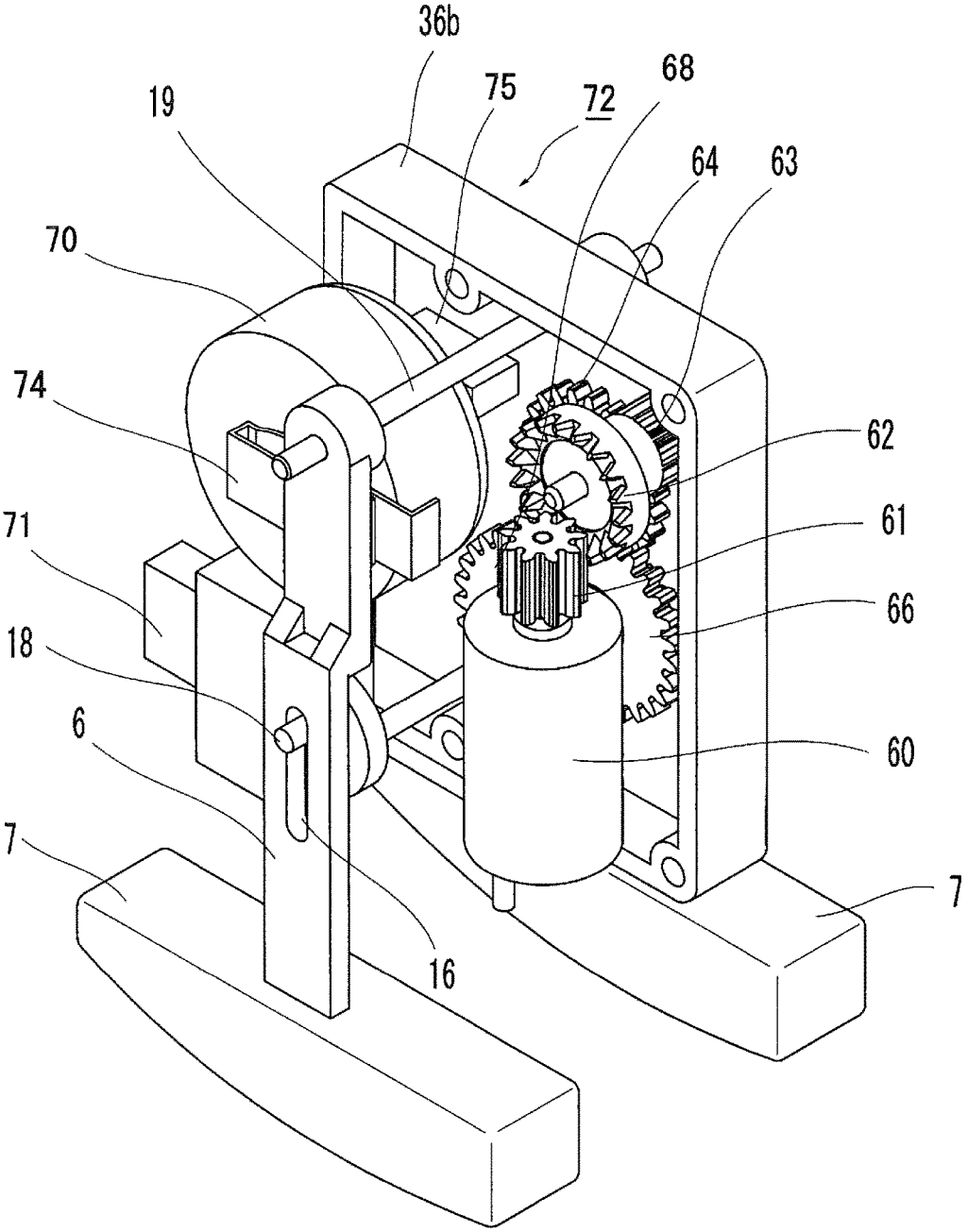
FIG. 16 is an exploded perspective view of a structure related to a gearbox of the walking toy in FIG. 13.
Figure 17:
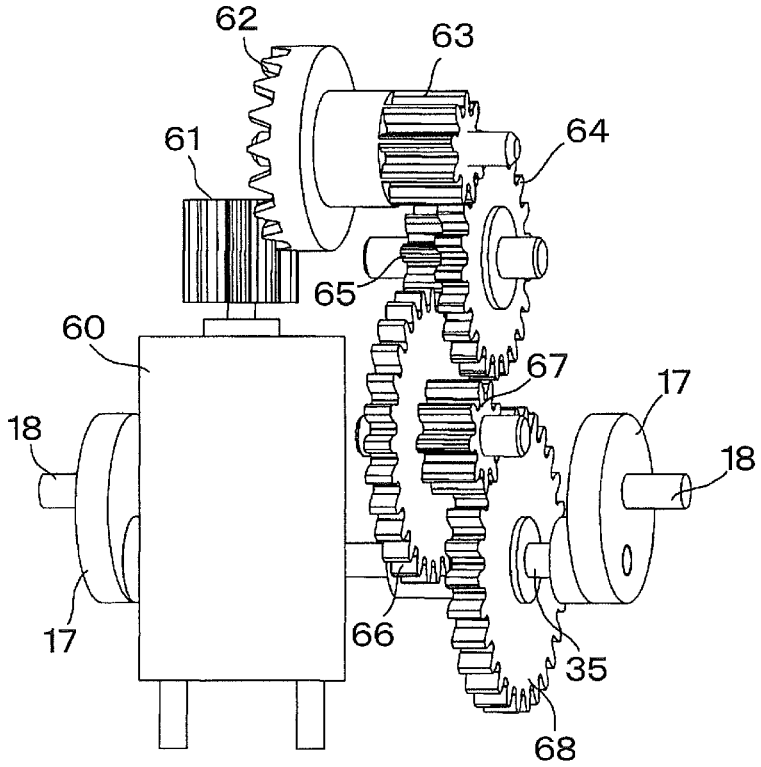
FIG. 17 is a perspective view showing a relationship between a drive motor and a gear train of the walking toy in FIG. 13.

The battery 70 is in contact with electrodes 74 and 75 and drives the direct-current motor 60 by operating a switch 71 protruding to an outside of the body 2. As a result, the walking toy 1 can travel. For example, the walking toy 1 can travel backward in the forward-inclined attitude as shown in FIG. 13 and can travel forward in the backward-inclined attitude as shown in FIG. 14.

Although parts configuring the gravity center position adjusting members are not shown in FIGS. 13 to 17, the arm 3 and the equipment item 4 may be provided, such as the above-described embodiment.

In the present specification, the forward-inclined attitude and the backward-inclined attitude of the walking toy 1 are mainly defined on the basis of a design of the character embodied by the walking toy 1. However, the attitude of the walking toy 1 may be decided by determining that a side which the lever 22 or the switch 71 sticks out is the back of the walking toy 1.

The invention claimed is:

1. A walking toy comprising: a body on which gravity center position adjusting members and paired legs are supported to be able to swing in a forward/backward direction; and a gearbox which has a crank mechanism for forcibly swinging the paired legs alternately forward and backward in a forcible swinging direction and which is mounted in the body, the paired legs having bottoms which are configured to be in contact with a floor surface and which are formed into curved faces curved in the forcible swinging direction, and the floor surface and the paired legs being constantly in contact with each other to allow the walking toy to travel by using the paired legs, wherein the gearbox is driven by a torsion coil spring and has a lever which rotates a drive gear of a gear train for transmitting rotation of the torsion coil spring to an output shaft for rotating the crank mechanism and which has a tip end portion protruding to an outside of the body, wherein the torsion coil spring is disposed between the lever and a frame of the gearbox and is configured to be twisted and wound by pushing down of the lever, wherein the lever is provided at a center in a left/right direction of the gearbox so as to be able to swing in a vertical direction and the gearbox is set in the body to be disposed at a center in the left/right direction of the body, wherein the left/right direction is perpendicular to the forward/backward direction, and wherein the lever has a disc portion at a center of rotation of the lever, the drive gear is formed at a portion of a peripheral face of the disc portion, a space for housing the torsion coil spring is formed on an inner side of the lever and the drive gear, one end of the torsion coil spring is housed in an internal space extending toward a tip end side of the lever, the other end of the torsion coil spring is in contact with the frame of the gearbox outside the internal space, and the torsion coil spring is twisted along a vertical plane orthogonal to the center of rotation of the lever at the center in the left/right direction of the body.

2. The walking toy according to claim 1, wherein the gravity center position adjusting members are disposed on opposite sides of the body, each of the gravity center position adjusting members includes an arm movably connected to the body and an equipment item to be attached to a tip end of the arm, and the arm has, at a tip end of the arm, a grasping portion for grasping the equipment item in such a manner that the equipment item can be detached.

3. The walking toy according to claim 1, wherein one of the gears forming the gear train is a climbing gear for revolving about a primary gear with which the climbing gear is to be engaged and which is closer to the drive gear than a secondary gear, the climbing gear is revolved to be disengaged from the secondary gear, with which the climbing gear is to be engaged and which is closer to the output shaft than the primary gear, so as not to transmit rotation of the gear train to the output shaft when the lever is operated to wind the torsion coil spring.

4. The walking toy according to claim 1, wherein each of the legs has the bottom with the curved face such that the curved face has a center of curvature in front, in a traveling direction, of a vertical axis passing through a center of swinging of the leg or has a center of curvature behind, in the traveling direction, the vertical axis, such that the curved face of the bottom is in contact with the floor surface at a position in front of the vertical axis passing through the center of swinging of the leg or at a position behind the vertical axis, and the curved face of the bottom is gradually separated from the floor surface and spaced from the floor surface behind the position of the contact or in front of the position of the contact, and the body is inclined in a direction and the walking toy moves in a direction opposite to the direction in which the body is inclined.

5. The walking toy according to claim 1, wherein the curved face of the bottom of each of the paired legs has a center of curvature on a vertical axis passing through a center of swinging of the leg, and is in contact with the floor surface at a position on the vertical axis passing through the center of swinging of the leg, and wherein the body stands upright.

6. The walking toy according to claim 4, wherein each of the paired legs includes a leg member to be swung in the forward/backward direction by the gearbox and a foot member which is detachably attached to a lower end of the leg member and has the bottom, and wherein each of the foot members is replaceable.

7. A walking toy set comprising the walking toy according to claim 1, and a track board having a track protruding from the floor surface, wherein the track is disposed between the paired legs of the walking toy in such a manner that the legs are positioned astride the track of the track board and the walking toy is allowed to travel along the track.

8. A walking toy set comprising a plurality of walking toys according to claim 1, and a track board having a plurality of tracks protruding from the floor surface, wherein each of the tracks is disposed between the paired legs of one of the plurality of walking toys in such a manner that the legs of one of the walking toys are positioned astride one of the tracks of the track board and the plurality of walking toys are simultaneously allowed to start traveling along the tracks to compete against each other.

9. The walking toy according to claim 5, wherein each of the paired legs includes a leg member to be swung in the forward/backward direction by the gearbox and a foot member which is detachably attached to a lower end of the leg member and has the bottom, and wherein each of the foot members is replaceable.

* * * * *